US006617575B1

(12) United States Patent
Cramer

(10) Patent No.: US 6,617,575 B1
(45) Date of Patent: Sep. 9, 2003

(54) MODIFIED ION SOURCE TARGETS FOR USE IN LIQUID MALDI MS

(75) Inventor: Rainer Karl Cramer, London (GB)

(73) Assignee: Ludwig Institute for Cancer Research, London (GB)

( * ) Notice: Subject to any disclaimer, the term of this patent is extended or adjusted under 35 U.S.C. 154(b) by 0 days.

(21) Appl. No.: 10/069,597

(22) PCT Filed: Sep. 26, 2000

(86) PCT No.: PCT/GB00/03691

§ 371 (c)(1),
(2), (4) Date: Feb. 28, 2002

(87) PCT Pub. No.: WO01/23863

PCT Pub. Date: Apr. 5, 2001

(30) Foreign Application Priority Data

Sep. 27, 1999 (GB) ..... 9922837

(51) Int. Cl.[7] ..... H01J 49/10

(52) U.S. Cl. ..... 250/288; 250/281; 250/300; 250/443.11; 250/442.11; 250/441.11; 250/440.11; 250/423 P

(58) Field of Search ..... 250/288, 281–300, 250/443.1, 442.11, 441.11, 440.11, 423 P

(56) References Cited

U.S. PATENT DOCUMENTS 5,171,995 A * 12/1992 Gast et al. ..... 250/339.08
5,716,825 A 2/1998 Hancock et al.
5,777,324 A 7/1998 Hillenkamp
5,965,884 A * 10/1999 Laiko et al. ..... 250/288
6,175,112 B1 * 1/2001 Karger et al. ..... 250/288
6,331,702 B1 * 12/2001 Krutchinsky et al. ..... 250/281

* cited by examiner

*Primary Examiner*—John R. Lee
*Assistant Examiner*—Zia R. Hashmi
(74) *Attorney, Agent, or Firm*—Nixon & Vanderhye, P.C.

(57) ABSTRACT

The present invention pertains to modified ion source targets suitable for use with liquid matrices (e.g., glycerol and lactic acid) in liquid matrix-assisted laser desorption/ionisation (MALDI) methods, as used, for example, in infrared (IR) liquid MALDI mass spectrometry (MS), preferably using time of flight (TOF) instruments. The modified targets comprise (a) a target plate (3) adapted for use in an ion source, said plate having an outward facing surface; and (b) a shielded sample cavity comprising: (i) a sample cavity (4) formed in said outward facing surface, said cavity having a sample cavity mouth and a sample cavity volume, and adapted to receive a liquid sample (5); and (ii) a perforated sample cavity shield (1), said shield covering said sample cavity mouth and having one or more exit holes through which ions formed inside the sample cavity may escape or be extracted. The present invention also pertains to ion sources, mass spectrometers, methods of MALDI and methods of mass spectrometry using such modified ion source targets.

34 Claims, 9 Drawing Sheets

Rel. Intensity
20000
15000
10000
5000
0
1000
2000
3000
4000
5000
6000
m/z

Rel. Intensity
20000
15000
10000
5000
0
1000
2000
3000
4000
5000
6000

Rel. Intensity
20000
15000
10000
5000
0
1000
2000
3000
4000
5000
6000
m/z

Rel. Intensity
20000
15000
10000
5000
0
1000
2000
3000
4000
5000
6000

Rel. Intensity
60000
50000
40000
30000
20000
10000
0
0
1000
2000
3000
4000
5000
6000
m/z Rel. Intensity
60000
50000
40000
30000
20000
10000
0
0
1000
2000
3000
4000
5000
6000
m/z Rel. Intensity
60000
50000
40000
30000
20000
10000
0
0
1000
2000
3000
4000
5000
6000
m/z Rel. Intensity
60000
50000
40000
30000
20000
10000
0
0
1000
2000
3000
4000
5000
6000
m/z Rel. Intensity
20000
15000
10000
5000
0
12100
12200
12300
12400
12500
12600
m/z m/δm ~ 2000
Rel. Intensity
5000
4000
3000
2000
1000
0
12100
12200
12300
12400
12500
12600

MODIFIED ION SOURCE TARGETS FOR USE IN LIQUID MALDI MS

This application is the US national phase of international application PCT/GB00/03691 filed Sep. 26, 2000 which designated the U.S.

TECHNICAL FIELD

This invention pertains generally to the field of matrix-assisted laser desorption/ionisation (MALDI) and MALDI mass spectrometry (MS). More specifically, the present invention pertains to modified targets suitable for use with liquid matrices (e.g., glycerol and lactic acid) in liquid MALDI methods, as used, for example, in infrared (IR) liquid MALDI MS, preferably using time of flight (TOF) instruments. The present invention also pertains to ion sources, mass spectrometers, methods of MALDI and methods of mass spectrometry using such modified ion source targets.

BACKGROUND

Traditional mass spectrometric methods are extremely useful for the analysis of low molecular weight compounds. However, for high molecular weight compounds, for example, biopolymers such as proteins and carbohydrates, the problem to be solved was to convert relatively non-volatile macromolecules into intact, isolated, and ionised molecules in the gas phase. A number of so-called desorption/ionisation techniques have been developed to solve this problem. In field desorption methods, a strong electric field is applied to the sample. In fast atom bombardment and $^{252}$Cf plasma desorption, the sample is bombarded by highly energetic ions or atoms. In thermospray ionisation and electrospray ionisation methods, ions are generated directly from small, charged liquid droplets. Laser desorption/ionisation (LDI) and the newly developed variant of this method, "matrix assisted laser desorption/ionisation" (MALDI), make use of short, intense pulses of laser light to induce the formation of intact gaseous ions.

Two factors dominate in the choice of laser for desorption methods. First, efficient and controllable energy transfer to the sample requires resonant absorption of the molecule at the laser wavelength. Consequently, lasers emitting in the ultraviolet (UV), which can couple to electronic states, or in the mid-infrared (mid-IR), which can excite rovibrational states, have so far shown the best results. Second, to avoid thermal decomposition, the energy must be transferred within a very short time. Typically, laser pulses or "shots" with durations on the order of 1 to 200 ns are employed. Given the short pulse durations, and the fact that laser beams can easily be focussed to spot sizes that are small compared with the other dimensions of the ion source, the ions are generated essentially at a point source in space and time, as a "packet" of ions. This pulsed desorption of ions favours the use of a time-of-flight (TOF) mass analyser, which makes it possible to record a complete mass spectrum for each laser shot. However, LDI methods may also be adapted for other mass spectrometers, including magnetic sector, quadrupole, Fourier transform ion cyclotron resonance (FT-ICR), and ion trap instruments.

In a time-of-flight (TOF) mass analyser, the velocity of an ion is used to determine its mass-to-charge ratio (m/z). A packet of ions is accelerated to a fixed kinetic energy by an electric potential, typically 1–30 kV. The velocity of a particular ion within the packet will then be proportional to $(m_i/z_i)^{-1/2}$, where $m_i/z_i$ is the ion's mass-to-charge ratio. The ions are then allowed to pass through a field-free region, typically 0.1 to 3 m in length, where they are separated into a series of spatially discrete individual ion packets, each travelling with a velocity characteristic of its mass and charge. A detector at the end of the field-free region produces a signal as each ion packet strikes it. A recording of the detector signal as a function of time is a TOF mass spectrum. The difference between the start time, common to all ions, and the arrival time of an individual ion at the detector is proportional to $(m_i,z_i)^{+1/2}$ and therefore can be used to calculate the ion's mass. Such a calculation can then be used to convert the axis of the spectrum from time into a mass-to-charge ratio axis, yielding a conventional mass spectrum.

The performance of mass spectrometers is typically described in terms of mass accuracy and mass resolving power. Mass accuracy is a measure of the error involved in assigning a mass to a given ion signal. It is typically expressed as the ratio of the mass assignment error divided by the mass o Of the ion and is frequently quoted as a percentage. Mass resolving power (also known as "mass resolution"), m/δm, is a measure of an instrument's capability to produce separate signals from ions of similar mass. For TOF instruments, it is typically expressed as the mass, m, of a given ion signal divided by the full width of the signal, δm, which is measured between the points of half-maximum intensity (FWHM). Factors which determine mass resolving power for a TOF instrument include the ion production time, initial velocity distribution, and extraction time. For example, conventional or "linear" TOF mass spectrometers may be adapted to include an "ion mirror," to yield a "reflectron" TOF mass spectrometer (reTOF), which permits correction for the peak width contribution arising from the initial energy distribution. Reflectron configurations effectively increase the ion's path length during separation, and therefore analysis time, and so increase susceptability to metastable effects.

The term "metastable" is used herein in the conventional sense to describe ions which fragment at some time after formation and before detection, typically during mass analysis. Since most mass spectrometers rely on the separation of species according to mass and charge, the fragmentation of a large ion into two or more smaller species will change the separation parameters mid-flight. Consider, for example, a packet of ions, $M_1^+$, some of which decay in flight (in the field free region of a TOF instrument) to form (lighter) daughter ions, $M_2^+$, and neutral daughter species, $M_3^0$. If, after fragmentation, the ions are subjected to an accelerating potential (e.g., an ion mirror in a reflectron instrument), then the parent and daughter ions will have different velocities. Both the parent ions, $M_1^+$, and the daughter ions, $M_2^+$, will be detected, but the latter at a mass intermediate between that of $M_1^+$ and $M_2^+$, according to the precise time of fragmentation and the accelerating potential. This can result in a smear or tail of intensity to lower mass (from $M_1^+$), and a consequent loss of resolving power. Metastable effects are largely dependent on the particular parent ion (e.g., greater metastable effects for labile and high mass ions), and the quantity and distribution of internal energy. Thus, ionization methods which deposit a large proportion of internal energy in levels which lead to bond-breaking and fragmentation often suffer from substantial metastable effects. For TOF instruments, metastable effects increase with increasing mass, since heavier ions have longer analysis times, and thus more opportunity to fragment before detection. For reflectron TOF (reTOF) instruments, the path length (and flight time) is also increased, again providing more opportunity for fragmentation prior to detection. Increasing background pressure, for example, in the field free region of a TOF instrument, have also been shown to increase metastable effects. See, for example, Berkenkamp, 1997.

Efforts to improve mass resolving power in TOF instruments have typically relied on focussing methods, to minimize the dependence of flight time on initial conditions. Examples of such methods include "velocity focussing" (typically used when the spatial distribution is narrow) and "space focussing" (typically used when the velocity distribution is narrow). See, for example, Vestal, 1998.

One method of "velocity focussing" employs a delayed extraction of ions, as compared to a immediate and constant (static) extraction of ions. In "static extraction" methods, ions are subject to a large constant accelerating potential (e.g., 10–20 kV) from the instant they are formed. In "delayed extraction" (DE) methods, also known as "time lag focussing," the application of the acceleration field is delayed for some time, $\Delta t$, after ion formation. For example, the ions may spend the first few hundred nanoseconds after formation in a field free environment, after which the acceleration potential is applied.

Another effort to improve resolving power for solid MALDI, by attempting to generate a more uniform velocity distribution through thermalisation of the ions, is described in U.S. Pat. No. 5,777,324 (Hillenkamp, 1998). This patent suggests the use of a cover, baffle, or compartment to impede or contain the plume formed during LDI within a baffle region, and so thermalise the ions before mass analysis. However, no data confirming the putative benefits (increased resolving power) for the proposed modifications are provided. A number of containment structures for solid MALDI are described. In one case, a box shaped compartment is constructed on top of the flat surface of the stage (rather than carved from the surface itself) with one or more exit apertures (FIGS. 3A and 3B, col. 5, line 61 through col. 6, line 11) with dimensions comparable to the that of the illumination spot, 10 to 500 $\mu$m (col 5, line 61 through col. 6, line 11). However, no teaching is provided regarding the number, size, or arrangement of exit apertures. In another case, containment is effected using a non-conducting fibrous or porous sheath (FIGS. 9A and 9B, col. 8, line 48 through col. 10, line 16) formed from a pulp-based fibrous paper (such as laboratory filter paper), glass, ceramic, or polymeric materials. Other "open" containment structures include open tubes (FIG. 5A), a lean-to structure (FIG. 6A), open wells (FIGS. 11 and 12A), and pins (FIGS. 10 and 12B). In each case, the containment structure is within the ion extraction region, and is presumably subject to extensive field penetration/ distortion.

Laser desorption/ionisation (LDI) has been used in combination with mass spectrometry since the early 1960's. In the mid-1980's it was recognised that the upper limit on the mass of molecules that could be desorbed as intact ions (at that time, about 1000 for biopolymers) could be substantially increased by the use of a suitable matrix component, and "matrix-assisted LDI" (MALDI) was born. See, for example, Hillenkamp et al., 1991a, 1991b, 1992.

Typically, as the technique now stands, a low concentration of analyte molecules, which usually exhibit only moderate absorption per molecule, is embedded in either a solid or liquid matrix consisting of small, highly absorbing species. Examples of solid matrices which have been shown to be effective include 2,5-dihydroxy benzoic acid (DHB), a mixture of DHB and 10% 5-methoxy salicylic acid, sinapinic acid, $\alpha$-cyano-4-hydroxycinnamic acid, nicotinic acid, 4-hydroxy picolinic acid, succinic acid, urea, and Tris buffer. Glycerol and lactic acid are examples of liquid matrices which have been used in IR MALDI. 3-Nitrobenzyl alcohol has been used as a liquid matrix for UV MALDI. Current reviews of MALDI methods are discussed in Bahr et al., 1994 and Hillenkamp et al., 1991c. Particularly with glycerol, users of MALDI have had to struggle with the problem of wanting enough matrix material to enhance LDI, but not so much that the matrix ion signal swamps out the analyte ion signal.

Although ultraviolet (UV) MALDI is now well established, infrared (IR) MALDI has enjoyed less popularity, primarily because of the high costs of infrared lasers and their limited availability in commercial MALDI instrumentation. However, recent publications have shown that IR MALDI is a valuable tool in the analysis of labile molecules such as phospho- and glycopeptides (Cramer, 1998) and RNA/DNA (Berkenkamp, 1998) and it can be anticipated that in the near future IR MALDI will be available as a standard option adding not more than 10–20% to the costs of a research grade MALDI TOF instrument.

IR MALDI offers a number of advantages over UV MALDI. In many cases, IR MALDI offers the advantage of being a "softer" method, as compared to UV MALDI, and is characterized by reduced metastable effects. This is despite the fact that apparently more of the absorbed laser energy goes into the analyte molecule in IR MALDI than in UV MALDI. One consequence of the softer nature of IR MALDI is that higher masses and labile biomolecules are accessible.

However, there are disadvantages inherent to the IR MALDI desorption process. The high penetration depth of infrared laser light in MALDI matrices promotes ablation rather than desorption leading, in the case of solid matrices, to a quick depletion of the irradiated sample spot and therefore the necessity, in many cases, to scan or raster across the whole sample. This clearly requires some skill, impairs mass accuracy due to space variation of the different desorption events, and is detrimental for automation.

One solution to this problem involves the use of liquid matrices. By using liquid matrices, an increased homogeneity of the analyte/matrix mixture can be achieved, the irradiated sample spot can replenish itself with sample, and therefore more successful desorption events can be obtained from the same spot at the same position in space. Several liquid matrices have been examined as possible matrices for IR MALDI, and in particular, glycerol. By using glycerol, and thus inducing only little internal energy, high mass and labile biomolecules can be detected intact, even in reflectron mode (which is more susceptible to metastable effects).

Successful detection of RNA and DNA containing more than a thousand nucleotides has been shown with glycerol (Berkenkamp, 1998; Kirpekar, 1999). However, it appears that glycerol exhibits different desorption characteristics than solid matrices. It has been reported (Feldhaus, 1999) that glycerol MALDI samples exhibit a higher threshold desorption energy at 2.94 $\mu$m than succinic acid samples, although the absorption coefficient of glycerol is about a factor of ten higher. Analyte ion energy measurements showed a high initial energy dependence on the extraction field and a much broader initial energy distribution compared to IR MALDI solid matrices, such as succinic acid (Berkenkamp, 1999) and UV MALDI solid matrices, such as DHB. Increasing the extraction field, for example, increases the initial analyte ion energy as well. This might explain the poor IR MALDI results with glycerol using extraction fields of more than 1000–1500 V/mm (Cramer, 1997; Talrose, 1999), typically found in commercial instrumentation in reflectron mode. More successful results with glycerol have been demonstrated using extraction fields much lower than 1000 V/mm, often found in "home-built" instruments. Further, the broader initial energy distribution observed with glycerol as matrix seems to restrict the maximum possible resolving power (Berkenkamp, 1999).

As discussed above, it has been shown that the "strength" or "hardness" of the extraction field has also been shown to influence the quality of spectra. Hard extraction fields (e.g., greater than about 1000 V/mm) are typical of commercial instrumentation, which employ a compact design with shorter extraction regions (e.g., ~2 mm), while softer extraction fields (e.g., less than about 1000 V/mm, and typically less than about 500 V/mm) are often found in "home-built" instruments which may employ longer extraction regions (e.g., >~5 mm) or lower ion extraction voltages (e.g., <=10–15 kV)

In published glycerol-assisted IR LDI studies of peptides and proteins, laser desorption was initiated from thin layers (Berkenkamp, 1997, 1999; Talrose, 1999), frozen samples (Berkenkamp, 1997; Kraft, 1998), nitrocellulose substrates (Caldwell, 1998) or a combination of these. IR liquid MALDI from thick droplets has not yet been reported or it has been noted that spectra acquired from thick glycerol droplets are inferior (Talrose, 1999), primarily suffering from a lack of analyte ion signal and excessively high matrix ion signals. These observations can be interpreted as indications of significant interference of the bulk sample which is volatilised during the desorption process. Desorption from thin layers, frozen samples or porous surfaces could also restrict the total amount of evaporated sample which leads to successful detection of the analyte.

It has been known for years that the employment of liquid matrices (e.g., glycerol) in IR MALDI can be difficult, if not impossible, primarily due to the lack of analyte ion signal. Ion sources typically found in commercial MALDI instrumentation, which utilise high voltage, hard extraction fields (>1000 V/mm), are not well suited for IR liquid MALDI, and, to date, there have been no reports of IR liquid MALDI using instrumentation from one of the major MALDI TOF MS manufacturers.

The modified ion source targets of the present invention seek to ameliorate many of the recognised problems associated liquid MALDI MS, and in particular, IR liquid MALDI MS.

In conventional liquid MALDI methods, a drop of liquid sample is deposited on the flat surface of an unmodified target plate. In the present invention, liquid sample is deposited in a sample cavity formed in the outward facing target surface; the loaded cavity is then covered with a perforated sample cavity shield having one or more exit holes through which ions formed inside the sample cavity may escape or be extracted. Without wishing to be bound to any particular theory, it is postulated that the shielded sample cavity of the present invention permits both access for the incident laser beam, and means for escape or extraction of ions generated inside the sample cavity, while reducing the rate of evaporation of the liquid sample. Also, it is postulated that the desorption and collisional dynamics, particularly inside the sample cavity (in the gap, see below), lead to increased analyte ion signal and reduced matrix ion signal, while maintaining good resolving power.

Thus, certain embodiments of the present invention enjoy benefits such as increased sensitivity in analyte ion detection and reduced matrix ion signal compared to the non-modified commercial targets which are used in a commercial hard extraction ion sources, mass resolving power comparable to the best achievable with conventional IR MALDI or UV MALDI, and decreased sample volatility leading to a five-fold increase in analysis time compared to using conventional target designs (up to 1 hour using volumes of only 250 nL). Furthermore, the design of the modified ion source targets appears to be universal and easy to implement on most, if not all, conventional target plates.

Accordingly, objects of the present invention (one or more of which are met by certain embodiments) include the provision of a modified ion source target which is suitable for use in liquid MALDI MS methods, particularly IR liquid MALDI MS methods, and which:

(a) yields improved analyte ion signal;

(b) yields reduced matrix ion signal;

(c) permits a mass resolving power comparable to or better than that observed for solid MALDI MS methods;

(d) permits increased sampling time;

(e) permits the use of a relatively low background pressure;

(f) is suitable for use with desirable liquid matrices, such as glycerol and lactic acid.

(g) meets one or more of the above objects while using relatively short extraction regions and relatively high extraction voltages, such as those found in common commercially available instruments; and, (h) meets one or more of the above objects, and which is a simple and inexpensive modification of a conventional ion source target.

BRIEF DESCRIPTION OF THE DRAWINGS

In FIG. 3A, a mask (7), held down by screws (8), holds the shield(s) in place over the cavities. In FIG. 3B, a single sheet of grid mesh material (9), held in place over the cavities by screws (8), is used as the shield for all of the sample cavities.

FIG. 4A is for a sample deposited on a normal plane target surface, and FIG. 4B is for a sample deposited on a modified ion source target of the present invention.

6A is for a normal plane target and FIG. 6B is for a modified ion source target of the present invention.

SUMMARY OF THE INVENTION

Figure 2A:
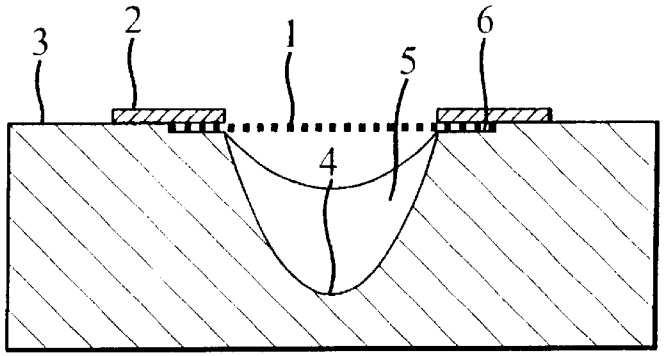
FIGS. 2A and 2B are schematics of target modifications for enhanced IR liquid MALDI in which an electron microscopy grid (1) is positioned in a shield recess (6) and is attached via adhesive tape (2) to the sample plate (3), and covering a machined hole in the sample plate (4), into which a liquid sample (5) has been placed.

One aspect of the invention pertains to a modified ion source target suitable for use in an ion source in an apparatus for matrix-assisted laser desorption/ionisation (MALDI), said modified target comprising: (a) a target plate adapted for use in an ion source, said plate having an outward facing surface; and (b) a shielded sample cavity comprising: (i) a sample cavity formed in said outward facing surface, said cavity having a sample cavity mouth and a sample cavity volume, and adapted to receive a liquid sample; and (ii) a perforated sample cavity shield, said shield covering said sample cavity mouth and having one or more exit holes through which ions formed inside the sample cavity may escape or be extracted.

In one embodiment, said target plate and said shield are formed from a metal or metal alloy and are electrically conductive, and said shield is in electrical contact with said target plate. In one embodiment, said sample cavity has a cross-sectional profile which is cylindrical, spherical section, or conical, or a combination and/or superposition thereof. In one embodiment, said shield has a plurality of holes. In one embodiment, said shield is formed from a bar mesh grid, a round hole mesh grid, or a slot mesh grid. In one embodiment, said shield is formed from a hole grid or a slot grid. In one embodiment, said shield is formed from a bar mesh grid having a density of about 200 to 800 mesh and a transparency of about 40 to 90%. In one embodiment, there is a shield recess around the periphery of said sample cavity mouth adapted to receive said shield. In one embodiment, said modified ion source target has a plurality of said shielded sample cavities. In one embodiment, a single perforated sample cavity shield covers a plurality of sample cavities.

Another aspect of the present invention pertains to a modified ion source as described herein, further comprising a liquid sample deposited in said sample cavity, said liquid sample comprising an analyte component and a liquid matrix component, wherein there is a gap between the surface of said liquid sample and said shield, and said liquid sample is not attached to, and does not envelop, said shield.

Another aspect of the present invention pertains to an ion source suitable for use in a mass spectrometer employing matrix assisted laser desorption/ionisation (MALDI), said ion source comprising a modified ion source target as described herein.

Another aspect of the present invention pertains to a mass spectrometer apparatus comprising an ion source as described herein. In one embodiment, the present invention is an apparatus for performing infrared (IR) liquid matrix assisted laser desorption/ionisation (MALDI) time of flight (TOF) mass spectrometry (MS) comprising an ion source as described herein.

Another aspect of the present invention pertains to a method ID of providing an ionic, gas phase, analyte species, said method comprising, in order, the steps of:

(a) providing a target plate adapted for use in an ion source, said plate having an outward facing surface and a sample cavity formed in said outward facing surface, said cavity having a sample cavity mouth and a sample cavity volume;

(b) depositing into said sample cavity a liquid sample, said liquid sample comprising an analyte component and a liquid matrix component;

(c) covering said sample cavity mouth with a perforated sample cavity shield, said shield having one or more exit holes through which ions formed inside the sample cavity may escape or be extracted;

thereby forming a modified ion source target, as described herein, in which a liquid sample has been loaded;

wherein there is a gap between the surface of said liquid sample and said shield, and said liquid sample is not attached to, and does not envelop, said shield; and, (d) installing said target plate in said ion source, and performing laser desorption/ionisation (LDI) to yield said ionic gas phase analyte species.

In one embodiment, said laser desorption/ionisation is infrared laser desorption/ionisation. In one embodiment, said matrix component is liquid and comprises glycerol and/or lactic acid.

Another aspect of the present invention pertains to a method of mass spectrometry which employs a method of providing an ionic, gas phase, analyte species as described herein. In one embodiment, the invention is a method of infrared (IR) liquid matrix assisted laser desorption/ionisation (MALDI) time of flight (TOF) mass spectrometry (MS) which employs a method of providing an ionic, gas phase, analyte species as described herein.

Another aspect of the present invention pertains to a method of increasing the ratio, $A^1/M^1$, of analyte ion signal, $A^1$, to matrix ion signal, $M^1$, in IR liquid MALDI MS, which method employs a modified ion source target, as described herein, and wherein the increased ratio, $A^1/M^1$, is greater than the ratio obtain using an unmodified target plate, $A^0/M^0$, by a factor of at least 2.

DETAILED DESCRIPTION OF THE INVENTION

Modified Ion Source Targets

Matrix-assisted laser desorption/ionisation (MALDI) mass spectrometers, like most other mass spectrometers, are equipped with a component designated "an ion source," from which ions are extracted for subsequent analysis. MALDI ion sources are further characterised by a "target" supporting a sample which is illuminated by an incident laser beam.

The present invention pertains to modified ion source targets, more specifically, ion source targets which are suitable for use with MALDI methods, and which differ from those used in conventional MALDI methods in that they further comprise one or more shielded sample cavities, as described herein.

The present invention also pertains to an ion source suitable for use in a mass spectrometer employing matrix assisted laser desorption/ionisation (MALDI), said ion source comprising a modified ion source target as described herein. The ion source is also suitable for use in hybrid instruments. The present invention also pertains to a mass spectrometer apparatus comprising such an ion source, including but not limited to an apparatus for performing infrared (IR) liquid matrix assisted laser desorption/ionisation (MALDI) time of flight (TOF) mass spectrometer.

The modified ion source targets of the present invention comprise: (a) a target plate adapted for use in an ion source, said plate having an outward facing surface; and (b) a shielded sample cavity comprising: (i) a sample cavity formed in said outward facing surface, said cavity having a sample cavity mouth and a sample cavity volume, and adapted to receive a liquid sample; and (ii) a perforated sample cavity shield, said shield covering said sample cavity mouth and having one or more exit holes through which ions formed inside the sample cavity may escape or be extracted.

The modified ion source targets of the present invention are typically derived from ion source targets, stages, plates, slabs, etc. which are normally used for MALDI MS ion sources, and which are typically in the form of a plate or modified plate. The ion source target typically also has holes, grooves, slots, and/or other shape and surface features which facilitate its installation in, and integral operation as part of, the ion source. Typically, such ion source targets are planar, or have a substantially planar aspect, particularly on the face from which ions are emitted or extracted (hereinafter referred to as the "outward facing surface" of the target). Ions are typically extracted from the ion source using an extraction electric field, and so planar or substantially planar outward facing surfaces are preferred so as to reduce or eliminate electric field distortion near this surface.

Typically, ion source targets comprise a relatively hard, relatively unreactive metal or metal alloy which has favourable handling, machining, thermal, and electrical properties. Typically, ion source targets are formed from an electrically conductive material. A common ion source and ion source target material is stainless steel, for example, Stainless Steel Type 304 (UNS number S30400). Typically, MALDI-MS ion sources and ion source targets are relatively small, having dimensions on the order of 1 to 10 cm.

Sample Cavity

As discussed above, the modified ion source targets of the present invention are characterised by one or more shielded sample cavities formed in the outward facing surface of the target plate, each of which cavities have a cavity mouth and a cavity volume, and adapted to receive a liquid sample.

The term "sample cavity" is used herein in the conventional sense, and relates to a blind hole, well, groove, slot, indentation, pit, or other recess which is formed in the outward facing surface of the target, and in which a sample is to be situated. By the term "formed in the outward facing surface" it is meant that the cavity is an open cavity, and that all or substantially all (e.g., at least 90%) of the cavity volume lies beneath the plane defined by the outward facing surface of the target plate. That is, the sample cavity is formed in the outward facing surface and is situated below or substantially below the plane of the outward facing surface.

Preferably, the sample cavity has a shape that is regular and symmetrical. In one embodiment, the sample cavity is characterised by an axis of rotational symmetry which is normal to or substantially normal to (e.g., within 10°) the outward facing surface. In one embodiment, the sample cavity is, or is substantially, cylindrical in shape. In one embodiment, the sample cavity is, or is substantially, conical in shape. In one embodiment, the sample cavity is, or is substantially, hemispherical or spherical-section in shape. In one embodiment, the sample cavity has a shape which is, or is substantially, cylindrical, conical, spherical-section, intermediate between any of the foregoing, or a combination and/or superposition of any of the foregoing. For example, a sample cavity formed by drilling using a simple drill bit has an approximately cylindrical shape with a rounded or conical bottom.

Typically, the sample cavity is characterised by one or more dimensions (e.g., maximum diameter, average diameter, average depth, maximum depth) which are on the order of millimetres, preferably from 0.1 to about 5 mm, more preferably from 0.2 to about 3 mm, yet more preferably from 0.25 to 2 mm. Typically, the cavity depth and cavity mouth dimension (e.g., diameter) are chosen to reduce or avoid shadowing when a laser incidence angle other than 0° is used. Thus, the cavity depth is typically selected to be less than the cavity mouth dimension (e.g., diameter). The sample cavity is also characterised by a sample cavity volume, which is defined by the sample cavity and the outward facing surface in which the sample cavity is formed. Typically, the sample cavity volume is on the order of tens of nanoliters to tens of microliters, preferably 10 nL to 20 $\mu$L, more preferably 20 nL to 10 $\mu$L, still more preferably 50 nL to 5 $\mu$L, still more preferably 0.2 to 2 $\mu$L.

A sample cavity which has a hemispherical shape is characterised by a diameter, D, and a resulting volume of $nD^3/12$. In a preferred embodiment, such a cavity has a diameter of from about 0.5 to 3 mm (volume of from 30 nL to 7 $\mu$L), more preferably about 1 to 2 mm (volume of from 0.3 to 2 $\mu$L).

A sample cavity which has a cylindrical shape is characterised by a diameter, D, a depth, H, and a resulting volume, V, of $nD^2H/4$. In a preferred embodiment, such a cavity has a diameter of from about 0.5 to 2 mm and a depth of from about 0.25 to 1 mm (volume of from 0.01 to 3 $\mu$L), more preferably a diameter of from about 1 to 2 mm and a depth of from about 0.5 to 1 mm (volume of from 0.4 to 3 $\mu$L).

A sample cavity which has a conical shape is characterised by a maximum diameter (i.e., cavity mouth diameter), D, a depth, H, and a resulting volume, V, of $nD^2H/12$. In a preferred embodiment, such a cavity has a maximum diameter of from about 0.5 to 2 mm and a depth of from about 0.25 to 1 mm (volume of from 0.02 to 1 $\mu$L), more preferably a diameter of from about 1 to 2 mm and a depth of from about 0.5 to 1 mm (volume of from 0.07 to 1 $\mu$L).

The sample cavity may be formed using conventional means, including mechanical, chemical, electrical, and radiation means, including but not limited to, cutting, drilling, punching, abrading, ablating, and eroding. One simple method for forming the sample cavity uses mechanical drilling. Whatever method is employed, it is usually preferable to ensure that the inside surface of the sample cavity, and preferably also the outward facing surface, are smooth, so as to facilitate effective cleaning and to reduce entrapment of undesired contaminants. Preferably, the inside surface of the sample cavity, at least, is polished to industrial standards to yield a high surface finish.

Figure 2B:
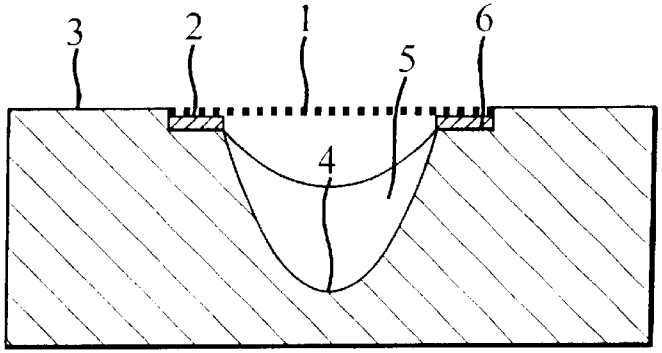

In some embodiments, as discussed below, there is a shield recess around some or all of the periphery of the mouth of the sample cavity, which recess is suitably adapted to receive, at least, part or all of the periphery of the perforated sample cavity shield. For example, a shield recess may be formed with a depth sufficient to accept the entire thickness of the perforated sample cavity shield, so that, when assembled, the shielded sample cavity has a flat, or substantially flat, profile. See, for example, FIGS. 2A and 2B.

As discussed above, the modified ion source targets of the present invention may have more than one shielded sample cavities on the outward facing surface. A plurality of shielded sample cavities may be particularly useful when analysing a large number of samples. For example, a large number of replicates and/or different samples can be analysed under virtually identical conditions. Also, modified ion source targets with a plurality of shielded sample cavities are readily compatible with automated (e.g., computer controlled) analysis. For example, computer controlled stepwise motion of the modified target under a fixed laser beam permits the simple and rapid sequential analysis of many samples. Alternatively, computer controlled positioning or rastering of the laser beam across an array of samples may be used. A combination of both target motion and laser beam motion may also be used. Thus, in a preferred embodiment, the modified target has a plurality of sample cavities arranged in a regular array, and, in many respects, is similar in form and function to a microtiter plate.

Perforated Sample Cavity Shield

As discussed above, the modified ion source targets of the present invention are characterised by a sample cavity covered by a perforated sample cavity shield.

The term "perforated sample cavity shield" (or "shield"), as used herein, pertains to a perforated shield which is situated at the mouth of the sample cavity, and which covers, or substantially covers, the mouth of the sample cavity. The term "perforated shield," as used herein, relates to a shield, cover, screen, mesh, grid, or the like which is characterised by one or more holes, perforations, openings, slots, or the like, which communicate directly with the sample cavity volume and which permit access for the incident laser beam and escape for, or extraction of, emerging ions.

The shield may be formed from an electrically conductive material, an electrically non-conductive (insulating) material, or a semiconductive material. In a preferred embodiment, the shield is formed from an electrically conductive material, such as a metal or metal alloy. Examples of suitable metals include, but are not limited to, copper, nickel, gold, gold plated copper or nickel, platinum, and platinum coated copper or nickel. Other metals and metal alloys may be used, including those which are suitably chemically unreactive, and which have favourable handling, machining, thermal, and electrical properties. In a more preferred embodiment, the target plate and the shield are formed from a metal or metal alloy and are electrically conductive, and the shield is in electrical contact with the target plate. In such cases, the gap above the surface of the liquid sample and below the shield (see below) is an essentially field free region (and substantially free of field penetration), and it is postulated that enhanced collisional cooling within this field free region may contribute to the improved spectra observed.

The shield is preferably planar or substantially planar. One advantage of a planar shield which is formed from an electrically conductive material and which is in electrical contact with an electrically conductive target plate, is the reduction of electric field distortion at the outward facing surface of the target.

In some embodiments, the shield has a single exit hole which communicates directly with the sample cavity volume, and through which ions formed inside the sample cavity may escape. In other embodiments, the shield has a plurality of exit holes. In some embodiments, the shield has from about 10 to about 2000 exit holes per square millimetre. In some embodiments, the upper limit is 2000, 1000, 500, or 200 exit holes per square millimetre. In some embodiments, the lower limit is 10, 20, 50, or 100 exit holes per square millimetre.

Many of the commercially available electron microscopy "grids" may advantageously be used to form suitable perforated sample cavity shields for use in the present invention. For example, a wide range of suitable grids are available from Agar Scientific Ltd. (Stansted, Essex, U.K.). Although typically referred to as "grids," some of these structures have a single hole while others have a large number of holes arranged in a regular pattern (the latter are referred to herein as "mesh grids"). Examples of grids with a plurality of holes are so-called thin bar mesh grids, thick bar mesh grids, round hole mesh grids, and slot mesh grids. Examples of grids with a single hole are so-called hole grids and slot grids.

In a preferred embodiment, the shield has a plurality of exit holes, and is formed from, for example, a thin or thick bar mesh grids, round hole mesh grids, and slot mesh grids. For shields with a plurality of holes, the transparency is partly chosen to balance the wish to increase the amount of analyte ions (but limit the amount of matrix ions) which escape from the sample cavity, and the wish to reduce the rate of evaporation of the liquid sample. In some of these embodiments, the grid has a transparency of from about 40 to 90%, more preferably from about 50 to 80%.

Commercially available "thin bar mesh grids" and "thick bar mesh grids" consist of bars or threads arranged in a regular pattern (often a square, rectangular, or hexagonal pattern) to yield a sheet or fabric which has holes or gaps between the individual strands. "Thin" bars are typically about 5–10 $\mu$m and "thick" bars are typically 10–25 $\mu$m. Such grids are collectively referred to herein as "bar mesh grids." Together, the thickness of the strand, the pattern, and the pattern density determine the grid's transparency, which is conventionally determined by projecting the grid onto a parallel plane. Typically, the pattern density is described in units of "mesh," meaning repeat units per inch.

For example, a thin bar mesh grid with a square pattern with bars 7 $\mu$m wide at a density of 200 mesh (8 bars per millimetre) has a square repeat unit of 127 $\mu$m×127 $\mu$m, "nominal" openings of about 113 $\mu$m, about 62 holes/mm$^2$, and a transparency of about (120×120)/(127×127) or about 89%. The corresponding 300 mesh grid (12 bars per millimetre) has a square repeat unit of 85 $\mu$m×85$\mu$m, "nominal" openings of about 78 $\mu$m, about 140 holes/mm$^2$, and a transparency of about (78×78)/(85×85) or about 84%. The corresponding 400 mesh grid (16 bars per millimetre) has a square repeat unit of 64 $\mu$m×64 $\mu$m, "nominal" openings of about 57 $\mu$m, about 240 holes/mm$^2$, and a transparency of about (57×57)/(64×64) or about 79%. Alternatively, a thin bar mesh grid with a hexagonal pattern with bars 7 $\mu$m wide at a density of 200 mesh (8 repeat units per inch) has a hexagonal repeat unit with parallel sides of hexagons separated by 127 $\mu$m between and an area of 0.866×127×127 or 14000 $\mu$m$^2$, about 72 holes/mm$^2$, and a transparency of about (0.866×120×120)/(0.866×127×127) or about 89%.

In a preferred embodiment, the shield is formed from a bar mesh grid with a pattern density of from about 100 to 1000 bars per inch (about 4 to about 40 bars per millimetre), and a transparency of from about 40 to 90%, as discussed above.

In an especially preferred embodiment, the shield is formed from a bar mesh grid with a pattern density of from about 200 to 800 bars per inch (about 8 to about 32 bars per 25 millimetre), more preferably from about 300 to 500 bars per inch (about 12 to about 20 bars per millimetre), most preferably about 400 bars per inch (about 16 bars per millimetre), and a transparency of from about 40 to 90%, as discussed above.

Commercially available "round hole mesh grids" consist of a sheet with circular holes arranged in a regular pattern (often a square, rectangular, or hexagonal pattern). Together, the diameter of the circular holes and the pattern density determine the grid's transparency, which is conventionally determined by projecting the grid onto a parallel plane. Typically, the pattern density is described in units of "mesh," meaning repeat units (e.g., holes) per inch. For example, a round hole mesh grid with holes 35 $\mu$m in diameter and spaced 75 $\mu$m centre-to-centre in a square pattern (therefore 340 mesh) has a repeat unit of 75 $\mu$m×75 $\mu$m, and a transparency of $n/4(35)^2/(75\times75)$ or 68%.

In a preferred embodiment, the shield is formed from a round hole mesh grid with a pattern density of from about 200 to 1000 holes per inch (about 8 to about 40 holes per millimetre), a hole diameter of about 20 to about 150 $\mu$m, and a transparency of about 40 to about 90%, as discussed above.

Commercially available "slot mesh grids" consist of a number of thin or thick bars arranged close together in a parallel fashion to give thin slots. Together, bar thickness and the pattern density determine the grid's transparency, which is conventionally determined by projecting the grid onto a parallel plane. Typically, the pattern density is described in units of "mesh," meaning repeat units (slots) per inch. For example, a slot mesh grid with bars 25 $\mu$m wide and slots 75 $\mu$m wide has a repeat distance of 100 $\mu$m, and a transparency of about (75/100) or 75%.

In a preferred embodiment, the shield is formed from a slot mesh grid with a pattern density of from about 200 to about 500 slots per inch (about 8 to about 20 slots per millimetre), a slot width of about 50 to about 100 $\mu$m, and a transparency of about 40 to about 90% as discussed above.

In another preferred embodiment, the shield has a single exit hole, as formed from, for example, a slot grid or a hole grid. For such shields, the size of the single exit hole is partly chosen to balance the wish to increase the amount of analyte ions (but limit the amount of matrix ions) which escape from the sample cavity, and the wish to reduce the rate of evaporation of the liquid sample. Of course, the larger the hole, the more the shielded cavity resembles an unshielded cavity, and the beneficial effects of the present invention are diminished. Commercially available hole grids consist of a sheet with a single hole of specified diameter, typically 75 to 2000 $\mu$m. Commercially available slot grids consist of a sheet with a single slot of specified dimensions, typically a few (e.g., 2–3) millimetres long and 10 to 1000 $\mu$m wide. In a preferred embodiment, the shield is formed from a slot grid with a slot width of about 50 to 300 $\mu$m, more preferably about 50 to 200 $\mu$m, more preferably about 50 to 100 $\mu$m. In another such embodiment, the shield is formed from a hole grid with a hole diameter of about 50 to 500 $\mu$m, more preferably about 100 to 300 $\mu$m.

The shield is preferably relatively thin, for example, on the order of 5 to 200 $\mu$m, more preferably on the order of 10 to 100 $\mu$m. In general, the thickness of the shield is chosen so as to reduce effects associated with the "length" of the hole. For example, if the laser beam is incident at any angle other than perpendicularly (0°), shadowing caused by the thickness of the shield may reduce the area of sample illuminated by the beam; as the angle of incidence increases, away from the normal and towards the plane, this effect is worsened. Also, as the shield thickness increases, the escaping ions may experience more of a "tunnel" than a "hole," and this may lead to undesired effects, such as reduced ion signal.

The hole(s) in the shield are linear or substantially linear in nature, in the sense that visible light may pass through the hole without obstruction or reflection. In this way, the shield has a degree of transparency. Thus, "holes" with a tortuous path, such as those associated with a porous material, are excluded. For example, pores through a filter paper or a fritted ceramic disk are not considered holes, in the sense used herein.

Attaching the Sample Cavity Shield

The perforated sample cavity shield is situated at the mouth of the sample cavity and covers, or substantially covers, the mouth of the sample cavity. As discussed below, after the sample has been introduced into the sample cavity, the shield is placed over the mouth of the sample cavity and affixed. The term "affixed" is used herein in the conventional sense, and describes the state of the shield being held firmly in place.

The shield may be affixed using any conventional fixative, including, but not limited to, adhesive materials, such as adhesive tapes, glues, pastes, and paints, and non-adhesive materials, such as masks or rings, which hole the shield in place by pressure/friction.

Preferably, the shield is affixed over the mouth of the sample cavity using methods which do not yield significant charging effects, such as ion repelling effects, field distortion, and the like. In a preferred embodiment, the shield is formed from an electrically conductive material, and is affixed so that it is in electrical contact with the target plate, as achieved, for example, by using an electrically conductive tape, glue, paste, or paint. In a preferred embodiment, the fixative is electrically conductive. If the fixative is not electrically conducting, it is possible to ensure that the shield is placed in electrical contact with the target plate using, for example, a wire or lead.

Figure 1A:
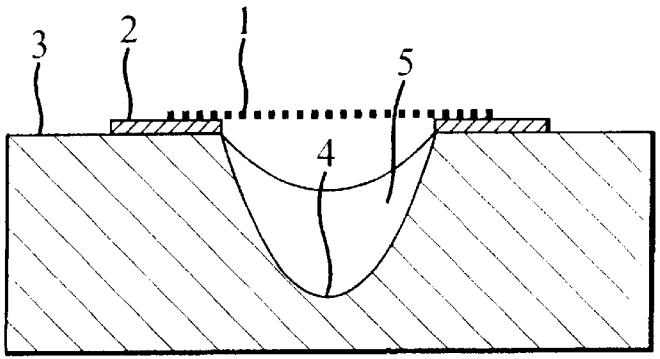
FIGS. 1A and 1B are schematics of target modifications for enhanced IR liquid MALDI in which an electron microscopy grid (1) is attached via adhesive tape (2) to the sample plate (3), and covering a sample cavity in the sample plate (4), into which a liquid sample (5) has been placed.
Figure 1B:
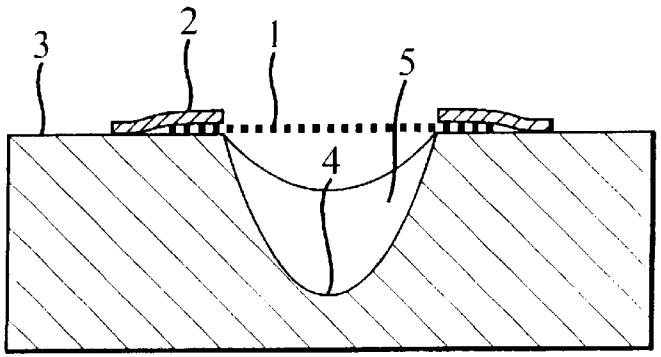

In one method, electrically conductive tape is used to secure the shield. For example, double sided electrically conductive tape may be placed around the mouth of the sample cavity and the shield pressed onto the outer adhesive surface. See FIG. 1A, in which an electron microscopy grid (1) is attached via conductive tape (2) to the sample plate (3), and covering a machined hole in the sample plate (4), into which a liquid sample (5) has been placed. Alternatively, the shield may be placed over the mouth of the sample cavity, and held in place by single sided electrically conductive tape applied at the periphery of the shield and the surrounding outward facing surface. (Using this configuration, electrically conductive tape is not necessary in order to ensure electrical contact). See FIG. 1B.

In a preferred embodiment, there is a shield recess (6) around some or all of the periphery of the mouth of the sample cavity, which recess is suitably adapted to receive some or all of the periphery of the perforated sample cavity shield. In this way, a flatter or more planar aspect is obtained, and electric field distortion effects are reduced. In one embodiment, the shield is placed in the shield recess and single sided electrically conductive tape is applied at the periphery of the shield and the surrounding outward facing surface. (Using this configuration, electrically conductive tape is not necessary in order to ensure electrical contact). See FIG. 2A. In one embodiment, the shield recess is deeper; double sided electrically conductive tape is first applied in the shield recess, and the shield is subsequently pressed onto the outer adhesive surface, in order to yield an even flatter aspect. (Using this configuration, electrically conductive tape might not be necessary in order to ensure electrical contact, since the edges of the shield might provide contact). See FIG. 2B. Of course, the (optionally electrically conductive) tape may be applied completely (for example, completely around the periphery of the shield) or partially (for example, at one or more points on the periphery), so long as the shield is held firmly in place and, preferably, electric field distortion is minimised.

In another preferred method, a retaining device is placed over the shield(s) to hold it (them) firmly in place. The use of a retaining device, instead of tapes, glues, pastes, and paints, may reduce or simplify handling, changing of shields, and cleaning of the target between uses. In such cases, there is also a shield recess, as described above. Any suitable retaining device may be used, including, for example, a mask with holes large enough to leave a portion of the shield exposed, but small enough to hold the shield(s) firmly over the mouth(s) of the sample cavity(ies). The retaining device (e.g., mask) may be held in place by tapes, glues, pastes, paints, etc. or more preferably, by screws, pins, clips, etc. See FIG. 3, which illustrates a target modification having a plurality of (in this case, four) sample cavities and which employs a mask (7), held down by screws (8), which hold the shield(s) in place over the mouths of the cavities.

Figure 3B:
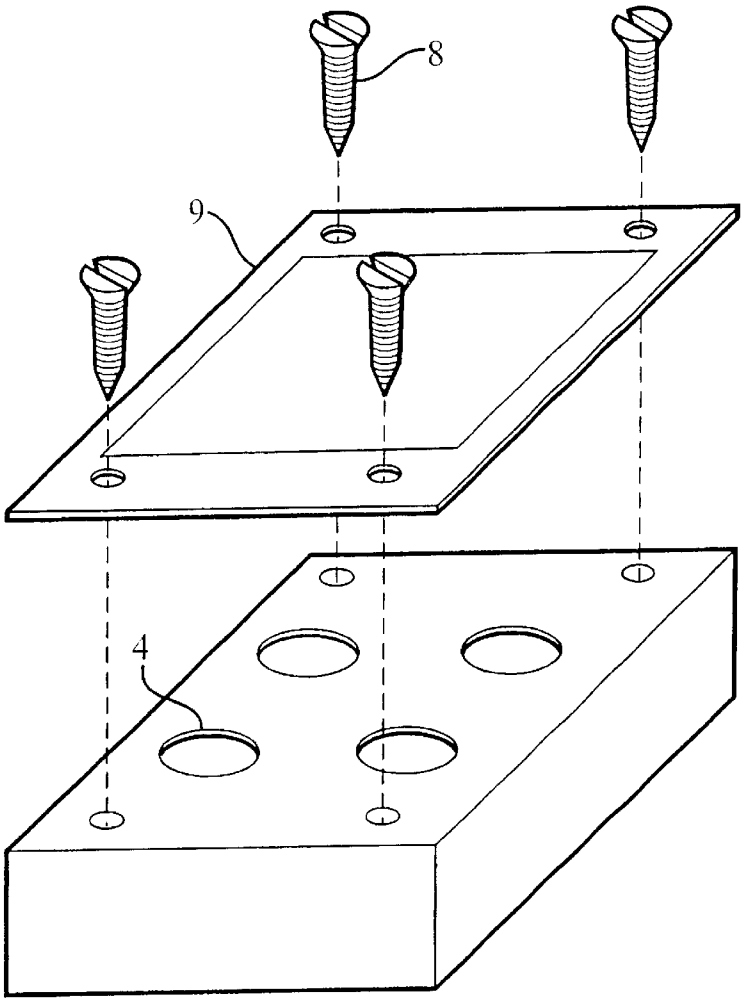
FIGS. 3A and 3B are schematics of target modifications having a plurality of sample cavities.
Figure 3A:
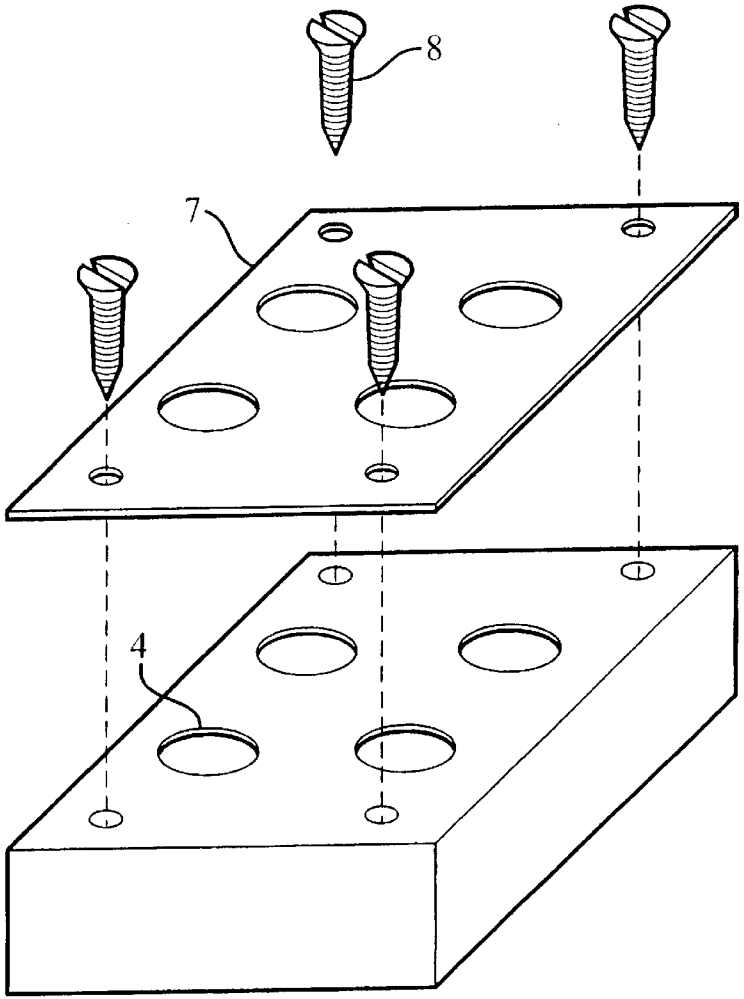

As discussed above, the modified ion source targets of the present invention are characterised by at least one shielded sample cavity on the outward facing surface. In one embodiment, the modified ion source target has a single shielded sample cavity. In one embodiment, the modified ion source target has a plurality of shielded sample cavities. In one embodiment, the modified ion source target has more than about 50 shielded sample cavities. In one embodiment, the modified ion source target has more than about 300 shielded sample cavities. In one embodiment, the modified ion source target has more than about 1000 shielded sample cavities. A modified target adapted for four shielded sample cavities is shown in FIG. 3.

Although it is preferred that each sample cavity has its own perforated sample cavity shield, it may be advantageous to use a single perforated sample cavity shield to cover a large number of sample cavities. For example, a target plate adapted to have a large array of sample cavities may be covered using a single sheet formed of a perforated material similar to that described above for the perforated sample cavity shield (e.g., 400 mesh screen). This sheet may then be held in place using a retaining device, for example, a mask with screws, as described above. To further simply handling, the sheet may be mounted in a frame, and the frame (and optionally a mask) may then be held in place by screws, pins, clips, etc.

Matrix, Analyte, and Sample

MALDI mass spectrometry is, by its nature, characterised by the use of a samples which comprise, at least, an analyte component and a matrix component.

The analyte component may comprise a single analyte species (for example, a specific protein) or a mixture of two or more analyte species (for example, a mixture of proteins). MALDI analyte species are typically organic (i.e., contain carbon and hydrogen), and typically have a relatively high molecular weight, from about 500 to 1,000,000 Da, though more typically about 1,000 to 100,000 Da. MALDI analyte species may be naturally-occurring or synthetic and may or may not be of biological origin. A common class of MALDI analyte species are biopolymers, including but not limited to oligomers and polymers of amino acids, (deoxy)ribonucleic acids, and saccharides. Examples of such biopolymers include, but are not limited to, DNA, RNA, proteins, glycoproteins, enzymes, antibodies, carbohydrates, and polysaccharides.

The matrix component primarily serves two functions: absorption of energy from the laser light, and isolation of the analyte molecules from each other. The former aids in the desorption process, and the latter reduces the desorption of multimer and aggregate species. The matrix component can also support the analyte ionization process in the gas phase, for example, by chemical ionization. Matrix components typically have good absorption properties, which may easily be determined for a particular laser wavelength. Matrix components may also be selected for their compatibility with analyte and analyte solvents, and their ability to form a homogeneous or substantially homogeneous solution/suspension/emulsion of the matrix/matrix solution and analyte/analyte solution which is suitable for analysis.

The matrix component may comprise a single matrix species or a mixture of two or more matrix species. A wide range of both solid and liquid materials have been shown to be useful as matrix components for use in IR and UV MALDI methods. For use in the present invention, the matrix component is preferably liquid. The term "liquid" is used in the conventional sense and relates to materials which, under MALDI experimental conditions (e.g., vacuum), have properties normally associated with liquids. Thus, the term liquid also encompasses very viscous liquids and gels. Examples of liquid matrix components which are suitable for use in the IR MALDI methods of the present invention include, but are not limited to, glycerol and lactic acid. An example of a liquid matrix component which is suitable for use in UV MALDI methods is 3-Nitrobenzyl alcohol.

In addition to the analyte component and the matrix component, other optional ingredients may also be present in the sample. Such optional ingredients include, but are not limited to, organic and inorganic solvents (such as water, methanol, acetonitrile), preservatives and stabilizers (such as ammonium citrate, e.g., 0.1 M aqueous ammonium citrate), acidic matrix solutions (e.g., succinic acid solution), and ion exchange media (e.g., cation exchange beads suspended in water; see Nordoff, 1992). Typically, such optional ingredients account for about 5–10% of the total sample volume.

An upper bound on the sample volume is provided by the sample cavity volume. Most preferably, the sample volume is selected so that a "gap" is present, as discussed below. Preferably, the sample volume is less than about 80% of the sample cavity volume. In other embodiments, the upper limit is 70%, 60%, 50%, 40% or 30%. Lower limits on sample volume are typically determined by sample handling methods and evaporation under vacuum conditions. Of course, a very deep sample cavity which is 80% full may yield the same gap, (and similar MALDI spectra) as a shallow sample cavity which is 50% full.

Also, the sample volume will, to a certain extent, determine the maximum length of analysis time, which is typically limited by evaporation from the sample.

Another consideration for sample volume is the need to maintain a relatively low back pressure for the ion source (e.g., the ion source chamber pressure), as well as for the extraction region and the mass analysis region. Acceptable pressures are typically on the order of $10^{-5}$ to $10^{-6}$ Torr ($1.3\times10^{-3}$ Pa to $1.3\times10^{-4}$ Pa) or lower for liquid matrices. If the sample volume is too large, or the matrix component is too volatile, it may become difficult to maintain a suitably low operating pressure. Using the modified ion source target of the present invention, operating pressures on the order of $10^{-7}$ Torr ($1.3\times10^{-5}$ Pa) are readily maintained with glycerol as matrix while still yielding high quality spectra with substantial analyte ion signal. In one embodiment, the operating pressure is less than $10^{-6}$ Torr ($1.3\times10^{-4}$ Pa).

Other considerations include sample handling techniques and limitations; for example, proven tools such as nanoliter pipettors and pin tools permit simple and reproducible delivery of nanoliter volumes into the sample cavity. Typically, volumes on the order of 10 to 20,000 nL (0.01 to 20 $\mu$L) are suitable, according to the sample cavity volume. In a preferred embodiment, the sample volume is from about 50 to 5,000 nL (0.05 to 5 $\mu$L), more preferably from about 100 to 1,000 nL (0.1 to 1 $\mu$L). For example, a sample volume of 250 nL (0.25 $\mu$L) may easily be delivered by a conventional pipettor and yields an analysis time on the order of several tens of minutes, and often up to an hour or more.

Samples may be prepared (e.g., mixed) before introduction into the sample cavity ("off target") or they may be mixed in situ in the sample cavity ("on target"). The sample may be prepared using conventional techniques. For example, the analyte may be provided in a liquid form, either neat or as a liquid solution, suspension, emulsion, etc. with one or more solvents. Aliquots of the liquid matrix component and liquid analyte solution or suspension may then be mixed to yield the desired liquid sample. Prior to mixing, the analyte concentration may be adjusted so that matrix and analyte aliquots are of convenient (e.g., comparable) volume. Alternatively, the analyte may be provided in the form of a solid, either neat or as a composite. It may be desirable to dissolve or suspend the solid analyte in a suitable solvent or solvents to yield a liquid analyte solution or suspension, and proceed as above. Also, if the solid analyte may be dissolved or suspended in the matrix component, then solid analyte may be added directly to the liquid matrix to yield the desired liquid sample. Preferably, the sample is compatible with or tolerant of sample cleaning steps, including, for example, the addition of sample purification liquids (e.g., cationic exchange bead suspension) which do not need to be removed before introduction into the sample cavity, or even before analysis.

The concentration of analyte component in the sample is limited, on the one hand, by the need for sufficient matrix component to yield the desired MALDI, and on the other hand by the sensitivity limit of the mass spectrometer. For IR liquid MALDI, the sample typically has an analyte to matrix molar ratio of from about $10^{-7}$ to about $10^{-3}$, more preferably from about $5\times10^{-6}$ to about $5\times10^{-4}$. Using the present invention, IR liquid MALDI MS has been successfully achieved with an analyte to matrix ratio of less than $2\times10^{-8}$.

Typically, reported spectra reflect signal averaging of a number of spectra for individual laser "shots," typically, from 10 to 10,000 shots. Sample consumptions per laser shot are typically on the order of tens of attomol ($10^{-17}$) to tens of femtomol ($10^{-14}$). Thus, the amount of analyte initially deposited in the sample cavity is typically from as little as (10) ($10^{-17}$) or $10^{-16}$ mol (100 attomol) to about (10,000) ($10^{-14}$) or $10^{-10}$ mol (100 picomol).

For example, a $10^{-4}$ M (moles per litre) stock solution of analyte which is mixed with glycerol at a 1:9 ratio, by volume, yields a sample which is $10^{-5}$ M in analyte (10 picomol/$\mu$L). At a molecular weight of 10,000 Da, this corresponds to 0.1 g/L (0.1 $\mu$g/$\mu$L). A 250 nL (0.25 $\mu$L) aliquot of sample then contains $2.5\times10^{-2}$ mol (2.5 picomol). At a molecular weight of 10,000 Da, this corresponds to $2.5\times10^{-8}$ g (0.025 $\mu$g, 25 ng)

Although possible, special handling methods (e.g., high or low temperature, high or low pressure, special atmosphere, clean room) are typically not required. However, samples are preferably prepared, handled, and stored with a view to reducing contamination.

Loading Sample and Assembling the Modified Ion Source Targets

In typical use, the modified ion source target is cleaned, an aliquot of sample delivered to the cavity (or each cavity if there are more than one), and the shield(s) positioned and affixed. The loaded and assembled modified ion source target is then installed in an ion source and mass analysis performed in the usual manner.

It is preferable to thoroughly clean the modified ion source target (including the sample cavity and the perforated sample cavity shield) prior to introduction of the sample into the sample cavity. For example, grooves caused by the hole drilling may give shelter to salt and other contaminants and therefore contribute to the amount of available cations (e.g., sodium and potassium) in the sample which may give rise to undesirable adduct ions. Proven conventional cleaning methods may be used, including, but not limited to, cleaning alternately with water and organic solvents, optionally with sonication. Once clean, suitable clean handling methods (e.g., the use of gloves and tweezers) are recommended.

The liquid sample is introduced into the clean sample cavity using conventional methods, for example, pipetting. As discussed above, the sample may be mixed "off target" or "on target." The perforated sample cavity shield is then positioned over the mouth of the sample cavity, and affixed.

Optimum enhancement of MALDI is observed in cases where there is a "gap" between the surface of the liquid sample surface and the perforated sample cavity shield, and in most cases where the liquid sample is attached to or envelops the shield, the resulting MALDI closely resembles MALDI from conventional plane target surfaces. Thus, a gap is preferably present between the surface of the liquid sample and the shield, and liquid sample is not attached to, and does not envelop, the shield. The term "gap," is used herein in the conventional sense to describe a rarefied space or volume, which is substantially free of solid or liquid material, but which may contain gaseous material, preferably at a pressure at or below atmospheric pressure at ambient temperature.

When vacuum is applied, air bubbles trapped at the bottom of the sample cavity by the liquid sample may give rise to "explosions" which may lead to liquid sample attached to, or enveloping, the shield. Highly volatile solvents in the sample may also give rise to similar explosions when vacuum is applied. Such explosions may often be avoided by introducing the filled sample cavity into prevacuum prior to positioning the shield.

Typically, the modified ion source target can be loaded with sample, assembled, installed in the ion source, and ready for analysis relatively quickly, typically within 2 to 15 minutes.

MALDI Mass Spectrometry

Once the sample has been introduced into the sample cavity and the perforated sample cavity shield fitted, the loaded and assembled target may be used as normal. For example, the loaded target may be installed in an ion source, and mass analysis performed using conventional MALDI methods which are well described in the art.

Thus, in one embodiment, the present invention pertains to a method of providing an ionic, gas phase, analyte species, said method comprising, in order, the steps of:

(a) providing a target plate adapted for use in an ion source, said plate having an outward facing surface;

(b) forming a sample cavity in said outward facing surface, said cavity having a sample cavity mouth and a sample cavity volume;

(c) depositing into said sample cavity a liquid sample, said liquid sample comprising an analyte component and a liquid matrix component;

(d) covering said sample cavity mouth with a perforated sample cavity shield, said shield having one or more exit holes through which ions formed inside the sample cavity may escape or be extracted;

thereby forming a modified ion source target according to the present invention, as described herein;

wherein there is a gap between the surface of said liquid sample and said shield, and said liquid sample is not attached to, and does not envelop, said shield; and, (e) installing said target plate in said ion source, and performing laser desorption/ionisation (LDI), preferably infrared (IR) laser desorption/ionisation to yield said ionic gas phase analyte species.

In another embodiment, the present invention pertains to a method of MALDI mass spectrometry which employs the above method.

Suitable MALDI methods include IR and UV MALDI, preferably IR MALDI. Suitable MS instruments include, but are not limited to, TOF and reTOF instruments, which may optionally be operated in DE mode. Suitable MS instruments also include hybrid instruments. Preferred methods include IR liquid MALDI TOF MS, IR liquid MALDI reTOF MS, IR liquid MALDI DE TOF MS, and IR liquid MALDI DE reTOF MS. Especially preferred are such methods which employ glycerol or lactic acid as matrix.

Briefly, suitable IR lasers for use in IR MALDI include, but are not limited to, TEA-$CO_2$ (10.6 $\mu$m) and Er:YAG (~3 $\mu$m). Suitable UV lasers for use in UV MALDI include, but are not limited to, $N_2$ (337 nm), excimer (193, 248, 308, and 351 nm), frequency-doubled excimer-pumped dye (220–300 nm), and Q-switched, frequency-tripled and quadrupled Nd:YAG (355 and 266 nm, respectively).

A critical parameter in an ion source designed to perform MALDI is the irradiance of the laser light at the sample. The minimum, or threshold, laser irradiance necessary to produce molecular ions from a sample is typically on the order of 1 MW/cm$^2$, corresponding to a laser fluence of 10 mJ/cm2 for a 10 ns laser pulse. The ion production threshold is typically sharp; it has been reported that below the threshold, ion production falls off to the fifth power of laser irradiance (Hillenkamp et al., 1991c). Best results are often obtained for a laser irradiance of no more than about 20% above the threshold for ion production. Laser pulse durations are typically on the order of 1 to 200 ns, with a corresponding irradiance and fluence. The size of focussed laser spot is typically in the range of 10 to 300 $\mu$m. A common configuration places the laser beam and the emitted ions on the same side of the target; in these cases, the angle of incidence (measured with respect to the target plane normal) is typically between 15° and 70°, though more extreme angles have been used successfully.

Suitable parameters, including laser wavelengths, intensities, and fluences, are easily determined by the skilled artisan. Using the modified ion source targets of the present invention, overpowering of the laser is of less concern, and one can substantially increase the laser power without quickly saturating the spectra with matrix ion signal. This feature provides a greater working range of laser intensity.

Recent studies of IR MALDI threshold fluences for Angiotensin I ions for succinic acid and liquid glycerol using an Er:YAG laser report that glycerol exhibits a 25% higher threshold than succinic acid, although the absorption coefficient of succinic acid at 2.94 $\mu$m is about one order of magnitude lower than that for glycerol (Feldhaus, 1999). However, using a modified ion source target as described herein, the threshold fluence values determined for these two matrices compare more favourably to their absorption coefficients, and this may be due to improved desorption/ionisation characteristics for IR liquid MALDI using this new target design.

Figure 4A:
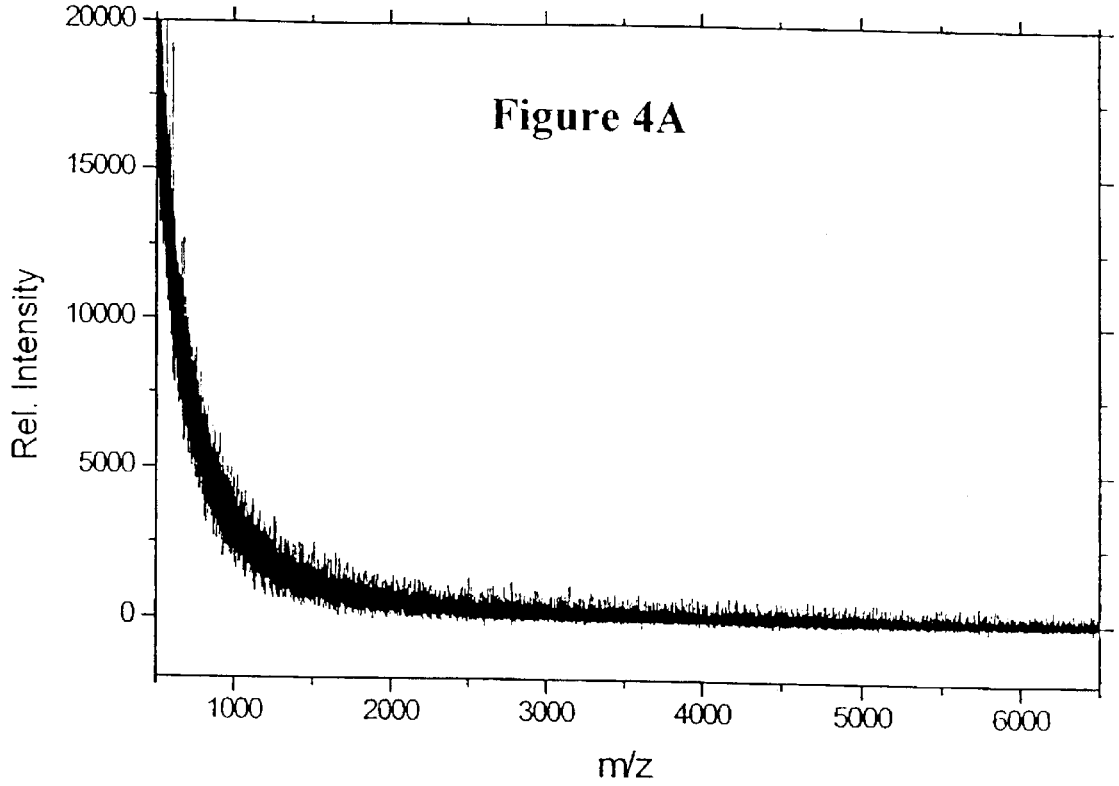
FIGS. 4A and 4B are IR MALDI mass spectra of an insulin sample using a glycerol matrix, as described in Example 1 and Comparative Example 1.

One advantage offered by many embodiments of the modified ion source targets of the present invention is an increase in analyte ion signal and a reduction of matrix ion signal, as compared to, for example, IR liquid MALDI using a conventional plane target and hard extraction conditions. For example, the analyte ion signal, which is virtually non-existent in FIG. 4A, is dramatically increased in FIG. 4B, and the matrix ion signal, which is saturated in FIG. 4A, is significantly decreased in FIG. 4B. The improvement in the ratio of analyte to matrix ion signal (A/M), for modified ion source targets of the present invention ($A^1/M^1$) as compared to a conventional, unmodified target plates ($A^0/M^0$), is typically at least 2-fold (i.e., $[A^1/M^1]/[A^0/M^0]>2$), preferably at least 3-fold, more preferably at least 5-fold, yet more preferably at least 10-fold, yet more preferably at least 20-fold. Thus, one aspect of the present invention pertains to a method of increasing the ratio ($A^1/M^1$) of analyte ion signal ($A^1$) to matrix ion signal ($M^1$) in IR liquid MALDI MS, which method employs a modified ion source target, as described herein, and wherein the increased ratio, $A^1/M^1$ is greater than the ratio obtain using an unmodified target plate, $A^0/M^0$, by a factor of at least 2.

It appears that IR liquid MALDI more effectively evaporates the sample than solid IR MALDI, that is, IR liquid MALDI leads to a higher ratio of molecular desorption to ablation of larger sample pieces than usually observed with solid IR MALDI. It is possible that the resulting denser molecular plume can effectively block the way for molecules with lower velocity (e.g., analyte ions), especially if, due to ion extraction requirements, the ion extraction must be applied at, or early after, the desorption event and before heavier ions have been able to emerge from the plume.

Without wishing to be bound by any particular theory, it is postulated that the reduced matrix ion signal indicates that there are fewer gas phase molecules (particularly matrix ions) in the ion acceleration region during ion extraction. Assuming that both collisional cooling and reduced high energy collisions are beneficial to MALDI, the detection improvements observed when using the modified ion source target of the present invention can be explained by the potentially lower gas densities during ion acceleration in the acceleration region of the ion source beyond the cavity shield (e.g., lower background pressure) and enhanced collisional cooling prior to ion extraction between the sample surface and the shield (i.e., in the gap).

These considerations can also explain the reported problems for IR liquid MALDI with hard extraction ion sources (high voltage and/or short ion extraction regions, which are typical in commercial instruments), where IR liquid (glycerol) MALDI typically results in matrix ion signals saturating a large portion of the low mass region. In contrast with conventional targets, the modified ion source targets of the present invention permit greatly reduced matrix ion signal, even with hard extraction ion sources (high voltage and/or short ion extraction regions). The reduction of matrix ion signal, relative to analyte ion signal, may also be due to improved desorption and plume dynamics.

Additionally, the negative effects of high energy collisions on ion stability/detection will be naturally intensified by higher extraction fields, specifically, higher collision energy. It appears that such effects can be avoided with the modified ion source target of the present invention and its influence on the plume dynamics during and prior to ion extraction.

Another advantage offered by certain embodiments of the modified ion source targets of the present invention is a prolonged analysis time compared to that obtained for the normal deposition of liquid samples on plane targets. Whereas in the latter case sample volumes of 200 nL evaporate within 10 min, the same sample volume can last for up to 1 hour with this new approach in liquid sample analysis. Furthermore, good quality mass spectra can still be acquired at a source chamber pressure of about $5\times10^{-7}$ Torr or less.

Another advantage offered by certain embodiments of the modified ion source targets of the present invention is a resolving power which is comparable to, if not better than, IR and UV solid MALDI. Typical linear MALDI TOF instruments report mass resolving power, m/δm, of about 300–500 with mass accuracies of about 0.01%. Much higher resolving powers have been reported for typical reflectron MALDI instruments, as high as 3000 for polypeptides up to mass about 2000 Da (about 20 amino acids). Even higher resolving powers are possible in delayed extraction (DE) mode, often up to 10,000 to 20,000.

Recent studies have reported significantly broader initial energy distributions and a more pronounced energy deficit for liquid matrices than for solid matrices (Berkenkamp, 1999) and it was suggested that the three times lower mass resolving power compared to solid IR MALDI could be accounted for by the broader initial energy distribution. Nonetheless, the mass resolving power observed for instruments employing the modified ion source target of the present invention appears to be at least as good as that observed with solid IR and UV MALDI on the same instrument using an unmodified target. Since no decrease in resolving power was observed, it can be tentatively assumed that the initial energy distribution is in line with solid IR MALDI, or alternatively, the increased resolving power may be the result of a higher extraction potential and/or shorter extraction region, which is compatible with the present invention.

It may be postulated that the improved mass resolving power is the result of some kind of thermalisation that occurs by collisional cooling in the dense plume between surface of the liquid sample and the perforated sample cavity shield before the ions leak through to the extraction region. In this way, the initial distribution could be compressed around an average energy value, losing much of its original width.

The following are examples are provided solely to illustrate the present invention and are not intended to limit the scope of the invention, as described herein.

EXAMPLES

All experiments were carried out on a Voyager Elite XL (PE Biosystems, Framingham, Mass.) MALDI delayed extraction (DE) reflectron time of flight (reTOF) mass spectrometer (MS). The instrument was modified to enable IR MALDI measurements with a Q-switched Speser 15Q (Spektrum GmbH, Berlin, Germany) Er:YAG laser. A detailed description has been published elsewhere (see Cramer, 1998). Briefly, the laser's wavelength was 2.94 μm, its pulse width was approximately 80 ns, and its beam was focussed on the target to approximately 200–300 μm in diameter irradiating the sample at 45° relative to the target surface normal. All spectra presented were recorded by accumulation of 64 laser shots from the same sample spot. The spectra shown have not been further processed by any data smoothing or baseline correction routines.

Example 1 and Comparative Example 1

Figure 4B:
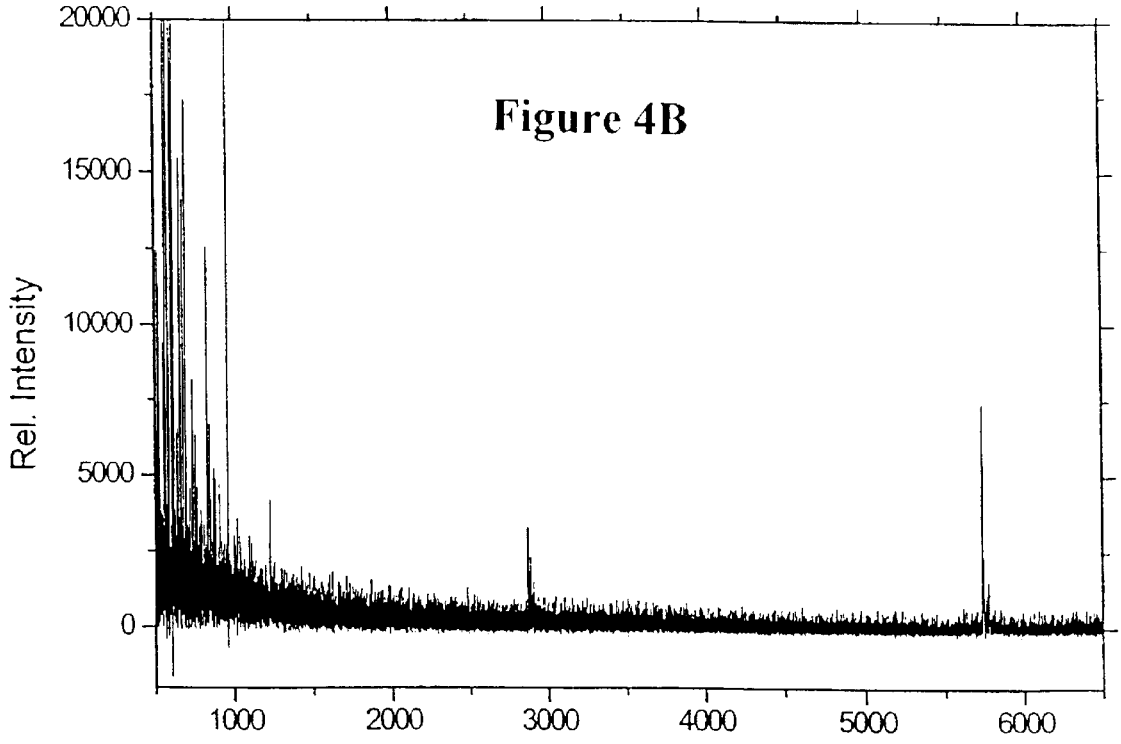

FIGS. 4A and 4B are IR MALDI mass spectra (500–6500 m/z) of a bovine insulin sample. A $10^{-4}$ M stock solution of bovine insulin (Sigma-Aldrich, Poole, Dorset, UK) in HPLCpure water was prepared. Stock solution and glycerol (99+% purity, G-5516, Sigma-Aldrich) were mixed (1:9 by volume) to yield a sample solution which was $10^{-5}$ M in bovine insulin. A 200 nL sample aliquot (corresponding to 2 μmol) was deposited in a drilled cavity about 1.5 mm wide and about 0.5–1.0 mm deep. A 400 mesh electron microscope grid (Agar Scientific Ltd., Stansted, Essex, U.K.) was attached over the cavity using electrically conductive tape (Agar Scientific Ltd.). The IR MALDI spectra shown in FIG. 4B was recorded (wavelength: 2.94 μm; 64 shots accumulated). For comparison, a 200 nL sample aliquot was deposited on a normal (unmodified) plane target surface, and the IR MALDI spectrum shown in FIG. 4A was recorded under comparable conditions.

FIGS. 4A and 4B compare the performance of IR liquid MALDI using glycerol under conditions normally applied for solid IR MALDI for the same sample deposited on a normal target surface without any modification (FIG. 4A) and deposited in the hole of the newly modified target and covered with an electron microscopy grid in electrical contact with the sample plate (FIG. 4B). It is evident that the analyte ion signal, which is virtually non-existent in FIG. 4A, is dramatically increased in FIG. 4B. Furthermore, matrix ion signal which is saturated in FIG. 4A is significantly decreased in FIG. 4B. It is important to note that without the electron microscopy grid (that is, sample deposited in an uncovered sample cavity), these changes in spectral quality were not observed.

Figure 8A:
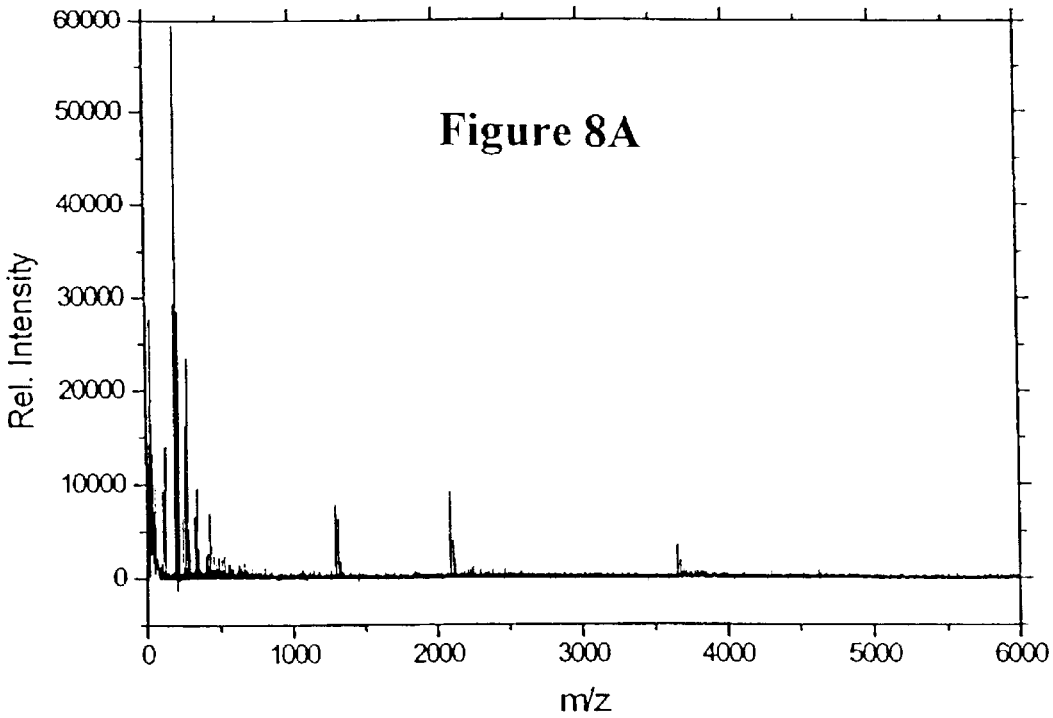
FIGS. 8A–8D are IR MALDI mass spectra of a calibration peptide mixture using a glycerol matrix and four different modified ion source targets, as described in Example 5.
Figure 8B:
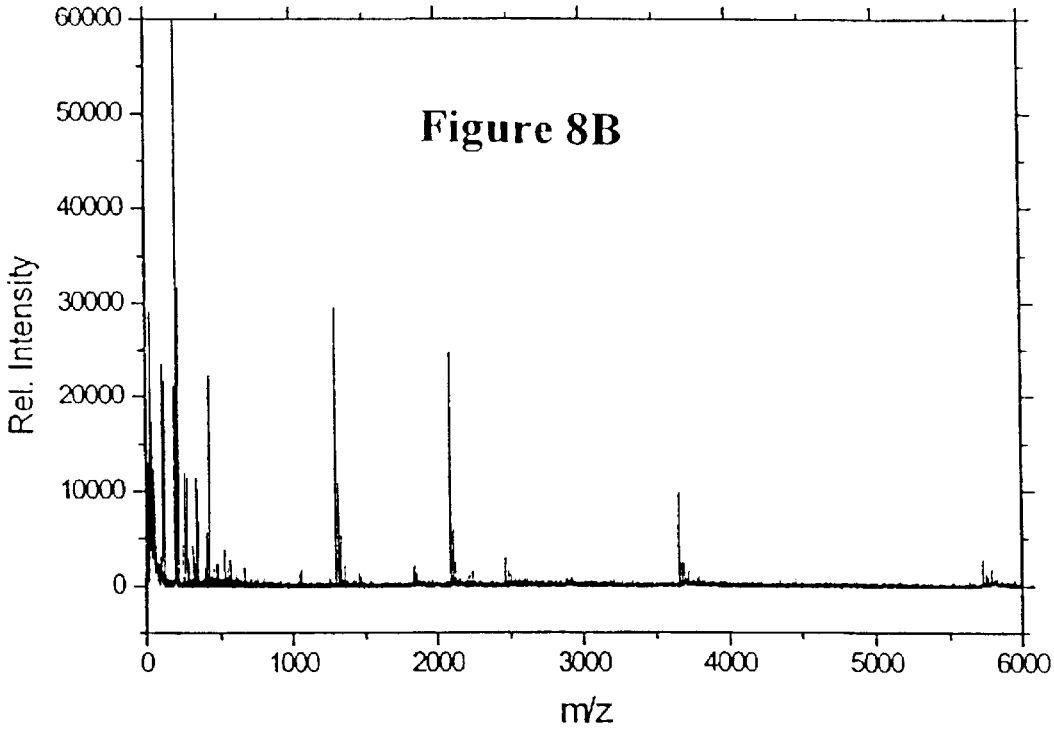
Figure 8C:
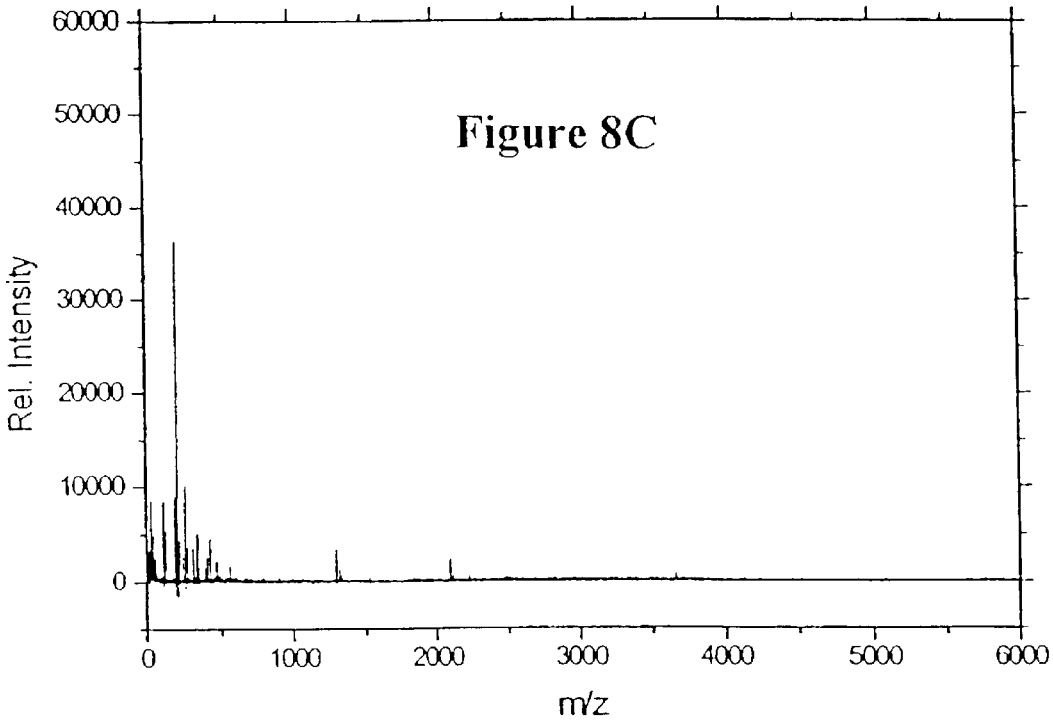
Figure 8D:
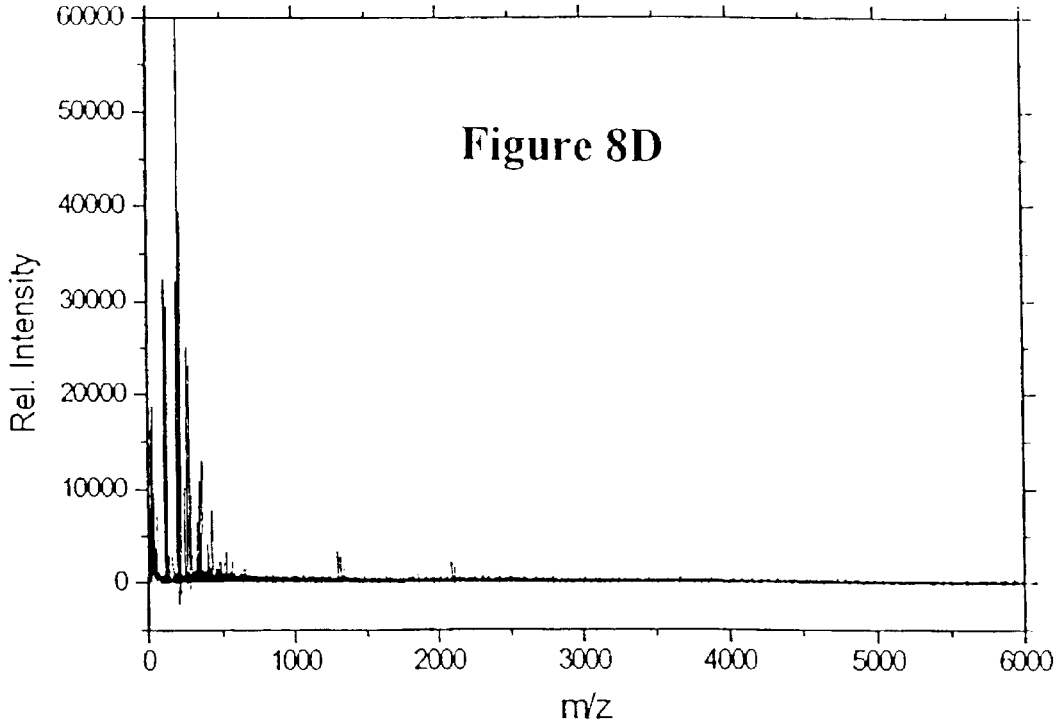

Under optimal conditions, which include slightly longer delay times for delayed ion extraction, observed mass resolving power was comparable to the best achievable in solid IR and UV MALDI using this instrumentation, specifically, up to 10,000 in the polypeptide mass range (up to about 6,000 to 8,000 Da; see FIG. 5) and around 2,000 for larger polypeptides (proteins) in the mass range about 10–25 kDa (~12 kDa in FIG. 8B).

Example 2

Figure 5:
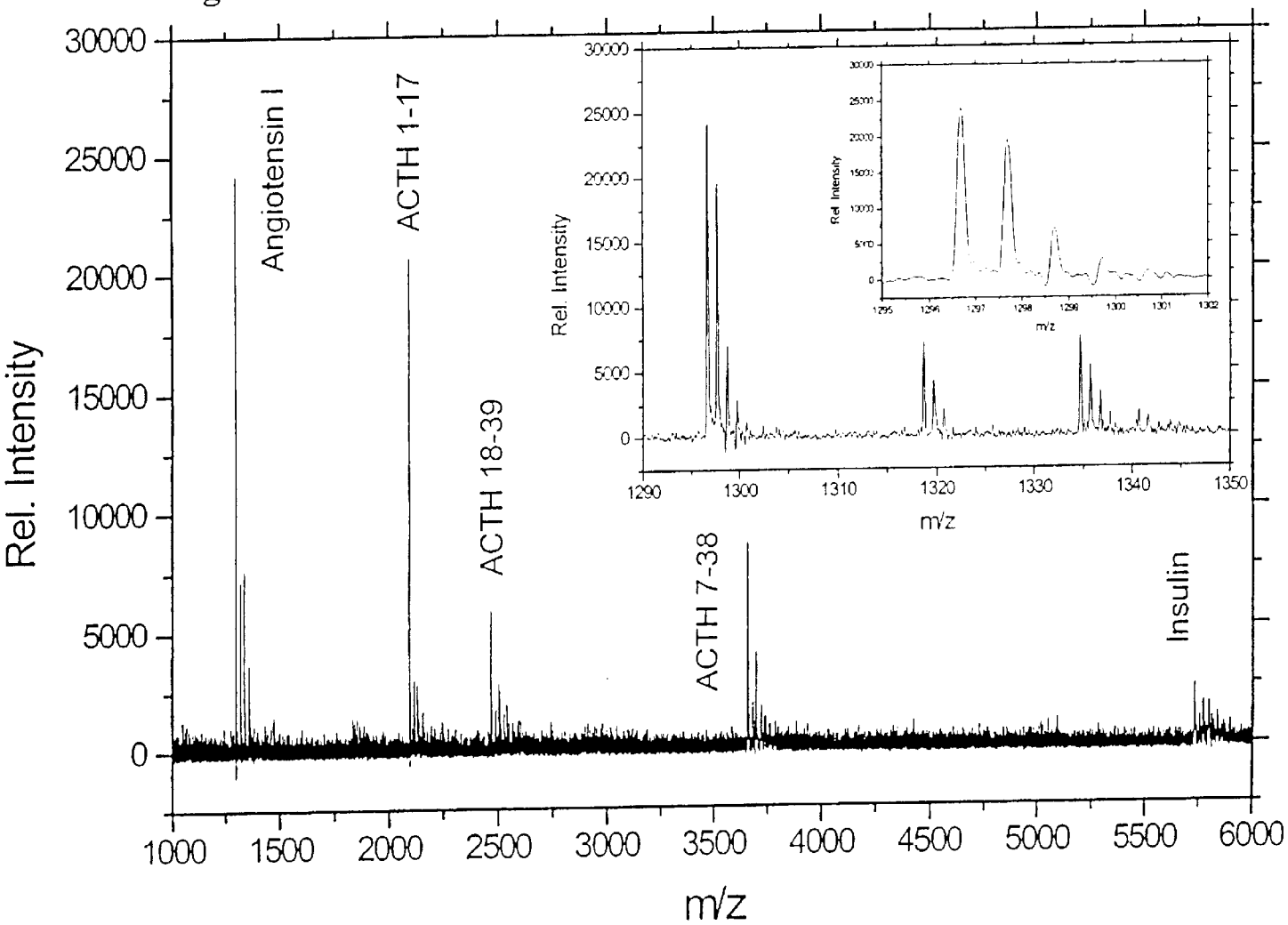
FIG. 5 is an IR MALDI mass spectrum of a calibration peptide mixture using a glycerol matrix as described in Example 2. Insets show magnifications of the Angiotensin I mass region.

FIG. 5 is an IR MALDI mass spectrum (1000–6000 m/z) of a calibration peptide mixture. Insets (1290–1350 m/z and 1295–1302 m/z) show magnifications of the Angiotensin I mass region.

The calibration peptide mixture was prepared using a commercially available Sequazyme™ Peptide Mass Standards Kit (Part Number 2-3143-00, PE Biosystems, Framingham, Mass., USA). Calibration Mixture 2 was used; this mixture contained angiotensin I, adrenocorticotropic hormone (ACTH) 1-17 clip, ACTH 18-39 clip, ACTH 7-38 clip, and bovine insulin. The solid material was dissolved in standard diluent (30% acetonitrile in 0.01% TFA) to give a concentration of about 25–75 μM. A 2 μL aliquot of this solution was mixed with 18 μL glycerol to give a sample with a final concentration of about 2.5–7.5 μM, or about 2.5–7.5 pmol/μL. A 250 nL aliquot of this sample (corresponding to about 0.6–2 pmol) was pipetted into a drilled cavity about 1.5 mm wide and about 0.5–1.0 mm deep. A 400 mesh electron microscope grid (Agar Scientific Ltd., Stansted, Essex, U.K.) was attached over the cavity using electrically conductive tape (Agar Scientific Ltd.). The IR MALDI spectra shown in FIG. 5 was recorded (wavelength: 2.94 μm; 64 shots accumulated).

The observed FWHM resolving power, m/δm, was ~7000 for Angiotensin (m/z~1297), ~8000 for ACTH clip 1-17 (m/z~2094), ~9000 for ACTH clip 18-39 (m/z~2467), and ~8000 for ACTH clip 7-38 (m/z~3660).

Example 3 and Comparative Example 2

Figure 6A:
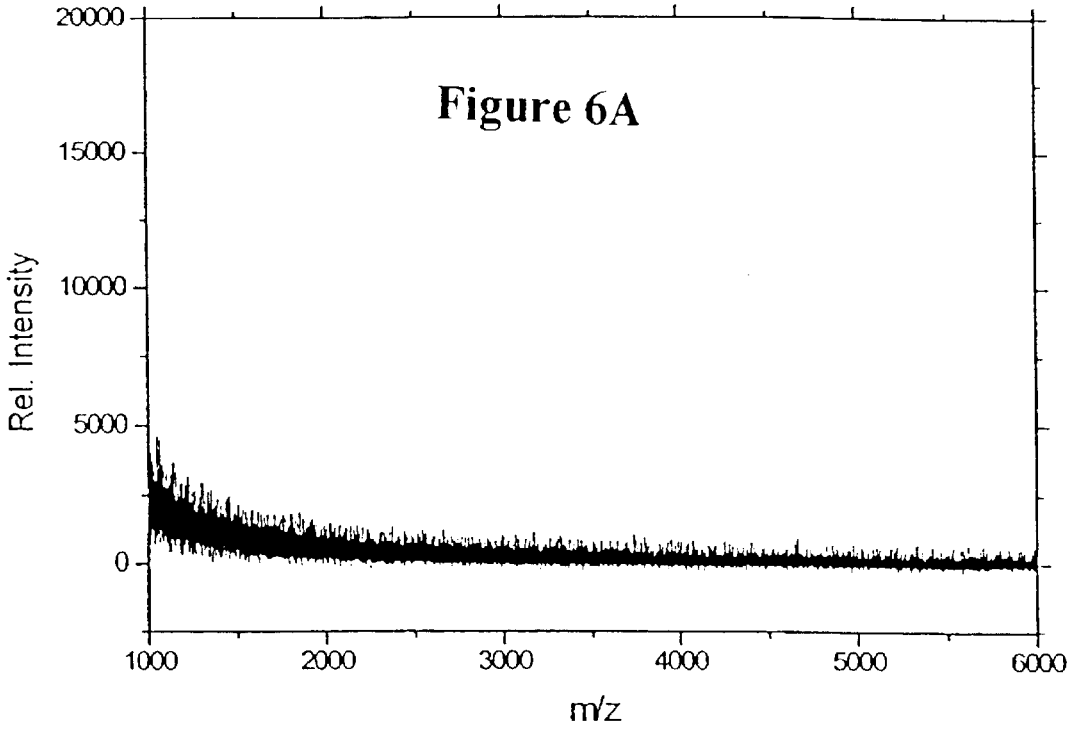
FIGS. 6A and 6B are IR MALDI mass spectra of a calibration peptide mixture using a lactic acid matrix as described in Example 3 and comparative Example 2. FIG.
Figure 6B:
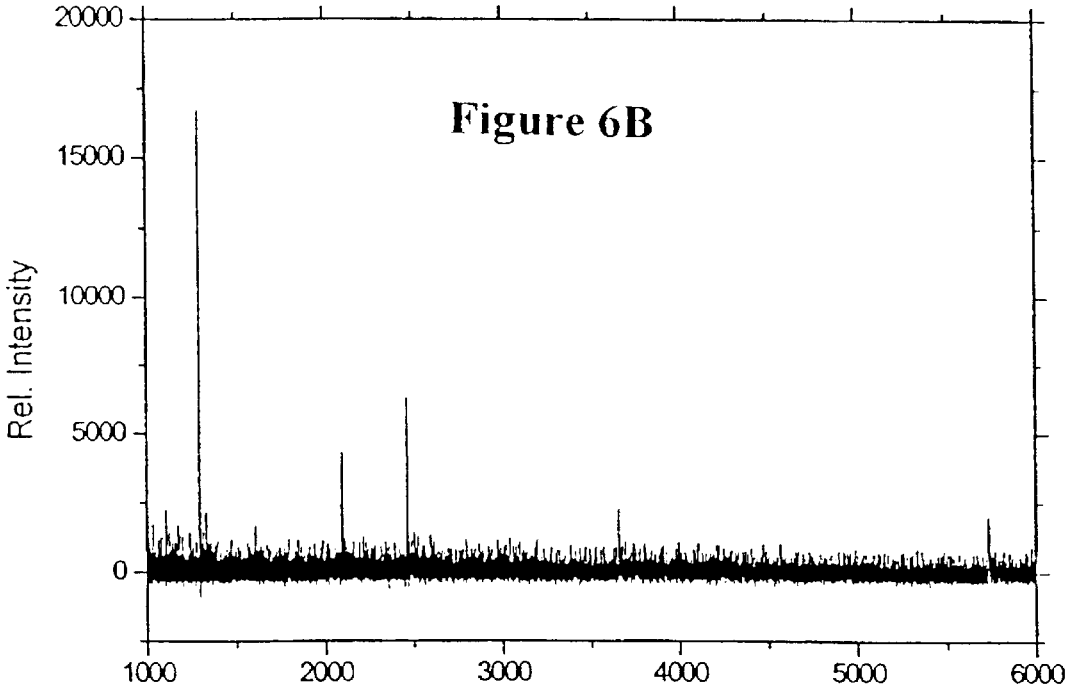

FIGS. 6A and 6B are IR MALDI mass spectra (1000–6000 m/z) of the calibration peptide used in Example 2, but using lactic acid (85% solution in water, L5-2, Sigma-Aldrich) instead of glycerol as matrix. FIG. 6A is for a sample deposited on a normal plane target surface, and FIG. 6B is for a sample deposited on the modified target as described in Example 2. All other parameters were unchanged from those in Example 2.

The spectra in FIGS. 6A and 6B illustrate that with this new target design, IR liquid MALDI is not only dramatically improved for glycerol but also for lactic acid. The results obtained with lactic acid appear to be very similar to those obtained for glycerol.

Example 4

Figure 7:
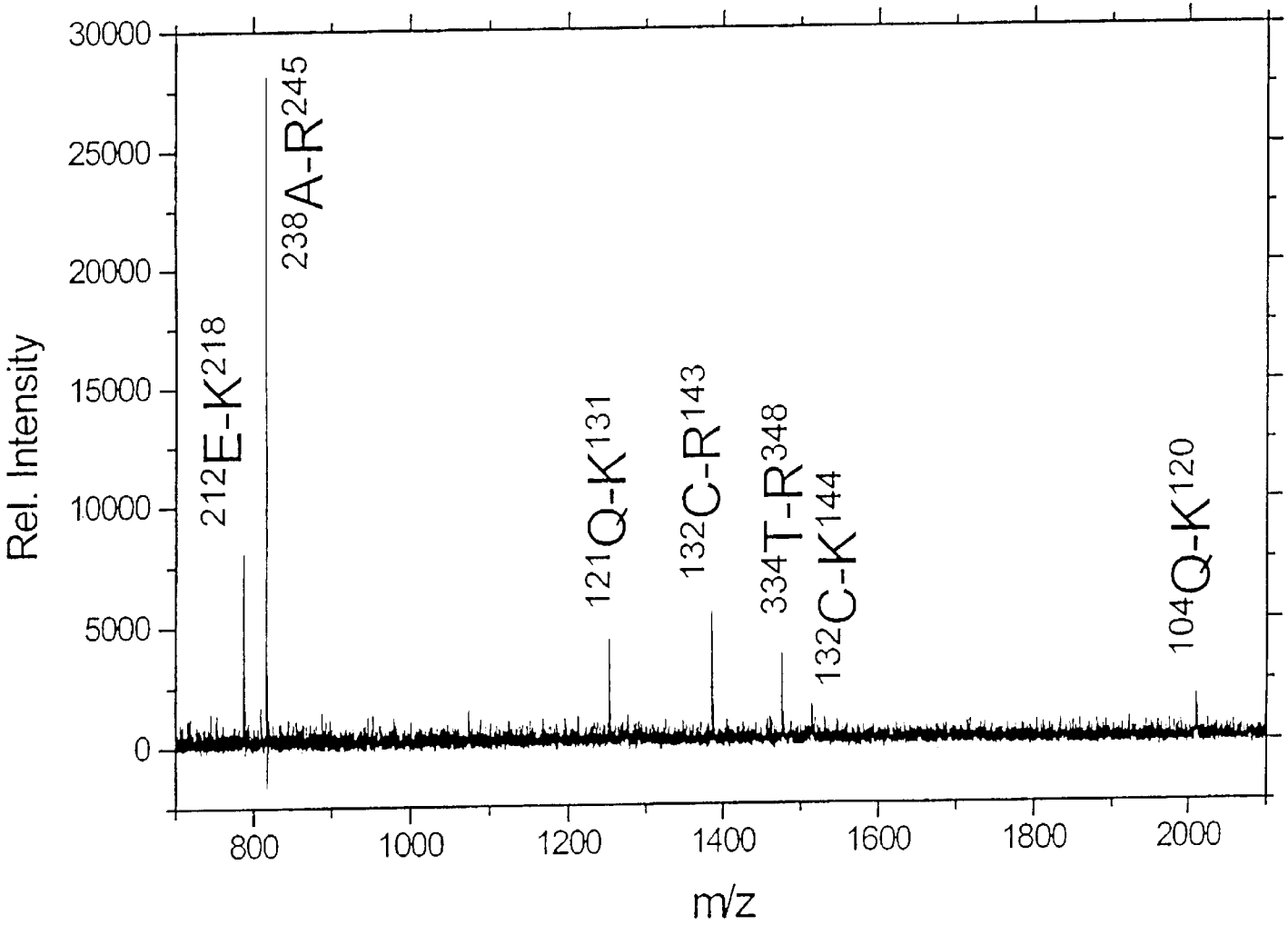
FIG. 7 is an IR MALDI mass spectrum of a bovine fetuin digest sample using a glycerol matrix as described in Example 4.

Sensitivity was examined by analysing a very dilute sample. FIG. 7 is an IR MALDI mass spectrum (700–2100 m/z; 1000 shots) obtained from a 200 nL (0.2 μL) bovine fetuin tryptic digest sample (200 fmol/μL) consisting of 50% 0.4 μM aqueous bovine fetuin tryptic digest solution (400 fmol/μL), 40% glycerol and 10% aqueous cation exchange bead suspension. The cation exchange bead suspension consisted of hydrogen loaded Dowex 50 beads suspended in HPLC-pure water (Nordoff, 1992). All other parameters were unchanged from those in Example 2. Good quality spectra were readily obtained with 1000 shots per sample, corresponding to 40 attomol of analyte being consumed per shot. The seven major peaks can be attributed to tryptic peptides of bovine fetuin. This information is sufficient to unambiguously identify the analyte by peptide mass mapping. Further dilution of the stock solution resulted in a rapid loss of peptide ion signal.

Example 5

The influence of different types of electron microscopy grids was evaluated using various commercially available grids. Although the employment of slot grids proved to be successful when the correct width (preferably<100 μm) was used, a comparison to the other grid types is difficult because of the different symmetry of these grids. Since, in these examples, the laser beam irradiated the sample at 45°, the positioning of the slot in relation to the laser beam significantly influences the performance. Therefore only mesh and hole grids were compared in detail.

FIGS. 8A–8D are IR MALDI mass spectra (0–6000 m/z) of the calibration peptide mixture used in Example 2. In each case, a different commercially available (Agar Scientific Ltd., Stansted, Essex, U.K.) grid was used as the sample cavity shield. All other parameters were unchanged from those in Example 2. For FIG. 8A, the shield was formed from a 200 mesh thinbar mesh grid ("G2002N Athene 200") (transparency: 86%). For FIG. 8B, the shield was formed from a 400 bar mesh grid ("G204G Athene Old 400") (transparency: 56%). For FIG. 8C, the shield was formed from a 1000 mesh thinbar mesh grid ("G2780N Agar 1000 Mesh Thinbar") (transparency: 58%). For FIG. 8D, the shield was formed from a 200 μm (single) hole grid ("G225N2 Athene Hole 200 μm").

The 400 mesh grid with 400 bars per inch and a transmission of 56% gave the best results. See FIG. 8B. Increasing the number of bars per inch while not changing the transparency appeared to impair the performance. On the other hand, an increase in the transparency did not necessarily result in an increase in the ion signal intensity. Surprisingly, good spectra could even be recorded from a liquid sample underneath a 200 μm hole grid, although estimates about the geometry suggest that the desorption spot was fully covered by the grid's solid part with respect to the projection using the surface normal, which is collinear to the ion extraction field vectors assuming a homogenous extraction field.

Example 6

Figure 9A:
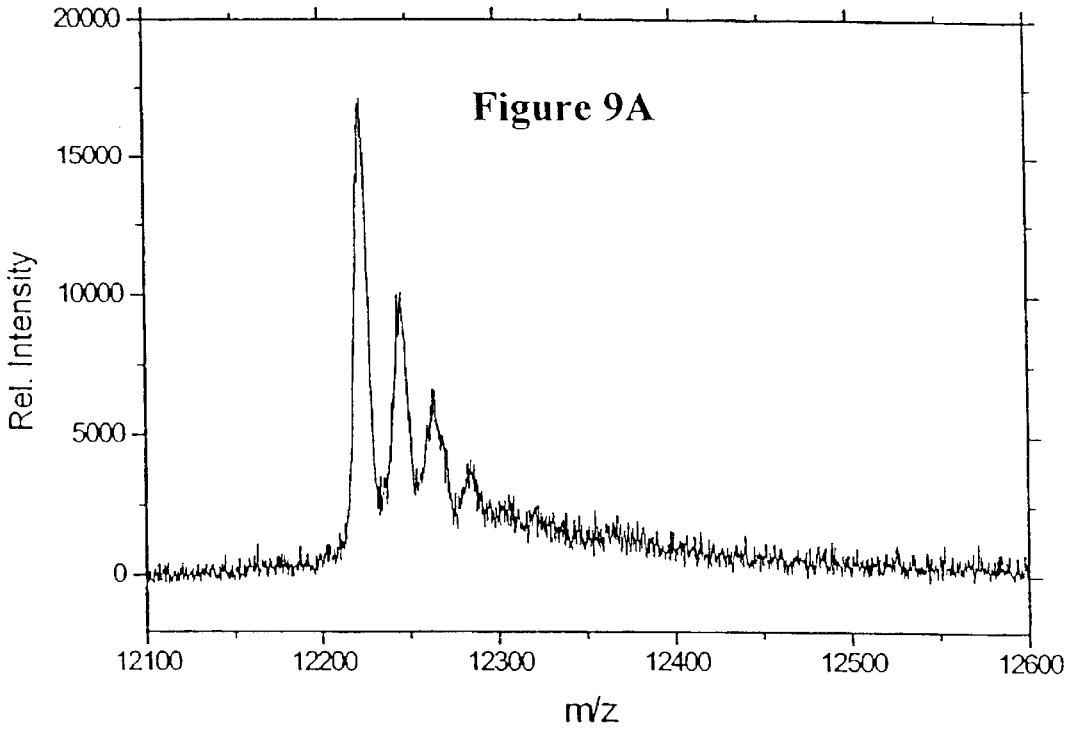
FIGS. 9A and 9B are IR MALDI mass spectra of chicken cytochrome c using different matrix formulations as described in Example 6.
Figure 9B:
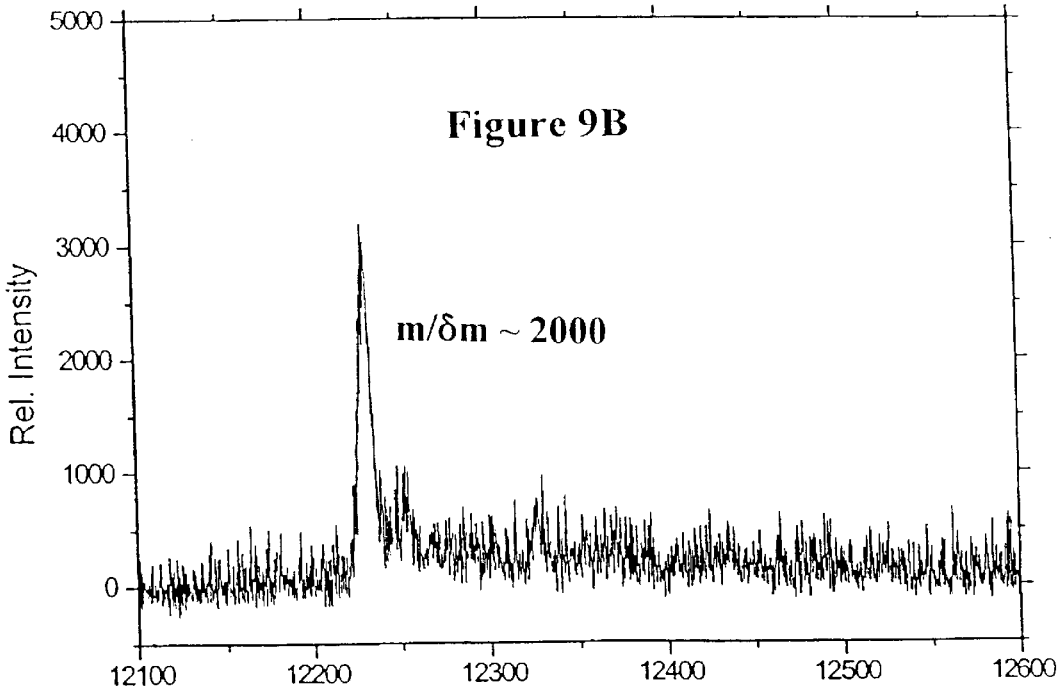

The addition of cation exchange beads, as an aqueous suspension, to the sample mixture, was examined as a means of minimising cation adduct formation. FIGS. 9A and 9B are IR MALDI mass spectra (12,100–12,600 m/z) of a 200 nL sample containing chicken cytochrome c (Sigma-Aldrich). The analyte was dissolved in HPLC-pure water to give a stock solution with a concentration of about 100 μM. Stock solution and matrix liquid were mixed (1:9 by volume) to yield a sample solution which was $10^{-5}$ M in chicken cytochrome c. For FIG. 9A, the matrix was a mixture of glycerol and water (9:1, by volume). For FIG. 9B, the matrix was a mixture of glycerol and aqueous cation exchange bead suspension (described above) (9:1, by volume). A 200 nL sample aliquot (corresponding to 2 pmol) was deposited in a drilled cavity about 1.5 mm wide and about 0.5–1.0 mm deep. A 400 mesh electron microscope grid (Agar Scientific Ltd., Stansted, Essex, U.K.) was attached over the cavity using electrically conductive tape (Agar Scientific Ltd.) and IR MALDI spectra recorded (wavelength: 2.94 μm; 64 shots accumulated).

In FIG. 9A, a typical cytochrome c spectrum with sodium and presumably potassium cation adduct formation is shown. This very common type of cation adduct formation can also be seen in FIG. 4. FIG. 9B demonstrates that treating the sample with cation exchange beads can alleviate such a formation. Although cation exchange beads seem to clean up the sample, a reoccurrence of cation adducts can often be observed after the sample has been analysed for some time. The use of cation exchange beads also seems to influence the ion signal intensity. However, even without cation exchange beads, spectra can be recorded without any sodium or potassium attachment.

REFERENCES

A number of patents and publications are cited above in order to more fully describe and disclose the invention and the field to which it pertains. Full citations for these references are provided below. Each of these references is incorporated herein by reference in its entirety.

Bahr et al., 1994, *Fresenius J. Anal. Chem.*, Vol. 348, pp. 783–791.

Berkenkamp et al., 1997, *Rapid. Commun. Mass Spectrom.*, Vol. 11, pp. 1399–1406.

Berkenkamp et al., 1998, *Science*, Vol. 281, pp. 260–262.

Berkenkamp et al., 1999, *Proc. 45th ASMS Conference on Mass Spectrometry and Allied Topics*, ThTC 073.

Caldwell et al., 1998, *Appl. Surf. Sci.*, Vol. 127–129, pp. 242–247.

Cramer, 1997, "Untersuchungen zur Infrarot-Matrix-unterstützten Laserdesorptions/-ionisations-Massenspektrometrie mit Hilfe eines Free-Electron Lasers," Dissertation, Westfälische Wilhelms-Universität Münster.

Cramer et al., 1998, *Anal. Chem.*, Vol. 70, pp. 4939–4944.

Feldhaus et al., 1999, *Proc. 45th ASMS Conference on Mass Spectrometry and Allied Topics*, ThTC 068.

Hillenkamp et al., 1991a, UK Patent No. 2,236,185, granted Mar. 23, 1994.

Hillenkamp et al., 1991b, UK Patent No. 2, 236,186, granted Jan. 5, 1994.

Hillenkamp et al., 1991c, *Anal. Chem.*, Vol. 63, No. 24, pp. 1193A–1203A.

Hillenkamp et al., 1992, U.S. Pat. No. 5,118,937, issued Jun. 2, 1992.

Hillenkamp, 1998, U.S. Pat. No. 5,777,324, issued July 7, 1998.

Kirpekar et al., 1999, *Anal. Chem.*, Vol. 71, pp. 2334–2339.

Kraft et al., 1998, *J. Am. Soc. Mass Spectrom.*, Vol. 9, pp. 912–924.

Nordhoff et al., 1992, *Rapid. Commun. Mass Spectrom.*, Vol. 6, pp. 771–776.

Talrose et al., 1999, *Proc. 45th ASMS Conference on Mass Spectrometry and Allied Topics*, ThTC 075.

Vestal, 1998, *J. Am. Soc. Mass Spectrom.*, Vol. 9, pp. 892–911.

What is claimed is:

1. A modified ion source target suitable for use in an ion source in an apparatus for matrix-assisted laser desorption/ionisation (MALDI), said modified target comprising:

(a) a target plate adapted for use in an ion source, said plate having an outward facing surface; and, (b) a shielded sample cavity comprising:

(i) a sample cavity formed in said outward facing surface, said cavity having a sample cavity mouth and a sample cavity volume, and adapted to receive a liquid sample; and, (ii) a perforated sample cavity shield, said shield covering said sample cavity mouth and having one or more exit holes through which ions formed inside the sample cavity may escape or be extracted.

2. A modified ion source target according to claim 1, wherein said target plate and said shield are formed from a metal or metal alloy and are electrically conductive, and said shield is in electrical contact with said target plate.

3. A modified ion source target according to claim 1, wherein said sample cavity has a cross-sectional profile which is cylindrical, spherical section, or conical, or a combination and/or superposition thereof.

4. A modified ion source target according to claim 2, wherein said sample cavity has a cross-sectional profile which is cylindrical, spherical section, or conical, or a combination and/or superposition thereof.

5. A modified ion source target according to claim 1, wherein said shield has a plurality of holes.

6. A modified ion source target according to claim 2, wherein said shield has a plurality of holes.

7. A modified ion source target according to claim 3, wherein said shield, has a plurality of holes.

8. A modified ion source target according to claim 4, wherein said shield has a plurality of holes.

9. A modified ion source target according to claim 1, wherein said shield is formed from a bar mesh grid, a round hole mesh grid, or a slot mesh grid.

10. A modified ion source target according to claim 2, wherein said shield is formed from a bar mesh grid, a round hole mesh grid, or a slot mesh grid.

11. A modified ion source target according to claim 3, wherein said shield is formed from a bar mesh grid, a round hole mesh grid, or a slot mesh grid.

12. A modified ion source target according to claim 4, wherein said shield is formed from a bar mesh grid, a round hole mesh grid, or a slot mesh grid.

13. A modified ion source target according to claim 1, wherein said shield is formed from a hole grid or a slot grid.

14. A modified ion source target according to claim 2, wherein said shield is formed from a hole grid or a slot grid.

15. A modified ion source target according to claim 3, wherein said shield is formed from a hole grid or a slot grid.

16. A modified ion source target according to claim 4, wherein said shield is formed from a hole grid or a slot grid.

17. A modified ion source target according to claim 1, wherein said shield is formed from a bar mesh grid having a density of about 100 to 1000 mesh and a transparency of about 40 to 90%.

18. A modified ion source target according to claim 2, wherein said shield is formed from a bar mesh grid having a density of about 100 to 1000 mesh and a transparency of about 40 to 90%.

19. A modified ion source target according to claim 3, wherein said shield is formed from a bar mesh grid having a density of about 100 to 1000 mesh and a transparency of about 40 to 90%.

20. A modified ion source target according to claim 4, wherein said shield is formed from a bar mesh grid having a density of about 100 to 1000 mesh and a transparency of about 40 to 90%.

21. A modified ion source target according to claim 1, wherein there is a shield recess around the periphery of said sample cavity mouth adapted to receive said shield.

22. A modified ion source target according to claim 1, having a plurality of said shielded sample cavities.

23. A modified ion source target according to claim 22, wherein a single perforated sample cavity shield covers a plurality of sample cavities.

24. A modified ion source target according to claim 1, further comprising a liquid sample deposited in said sample cavity, said liquid sample comprising an analyte component and a liquid matrix component, wherein there is a gap between the surface of said liquid sample and said shield, and said liquid sample is not attached to, and does not envelop, said shield.

25. An ion source suitable for use in a mass spectrometer employing matrix assisted laser desorption/ionisation (MALDI), said ion source comprising a modified ion source target according to claim 1.

26. A mass spectrometer apparatus comprising an ion source according to claim 25.

27. An apparatus for performing infrared (IR) liquid matrix assisted laser desorption/ionisation (MALDI) time of flight (TOF) mass spectrometry (MS) comprising an ion source according to claim 25.

28. A method of providing an ionic, gas phase, analyte species, said method comprising, in order, the steps of:

(a) providing a target plate adapted for use in an ion source, said plate having an outward facing surface and a sample cavity formed in said outward facing surface, said cavity having a sample cavity mouth and a sample cavity volume, and adapted to receive a liquid sample;

(b) depositing into said sample cavity a liquid sample, said liquid sample comprising an analyte component and a liquid matrix component;

(c) covering said sample cavity mouth with a perforated sample cavity shield, said shield having one or more exit holes through which ions formed inside the sample cavity may escape or be extracted;

thereby forming a modified ion source target according to claim 21, in which a liquid sample has been loaded;

wherein there is a gap between the surface of said liquid sample and said shield, and said liquid sample is not attached to, and does not envelop, said shield; and, (d) installing said target plate in said ion source, and performing laser desorption/ionisation (LDI) to yield said ionic gas phase analyte species.

29. The method according to claim 28, wherein said laser desorption/ionisation is infrared (IR) laser desorption/ionisation.

30. The method according to claim 28, wherein said matrix component is liquid and comprises glycerol and/or lactic acid.

31. The method according to claim 29, wherein said matrix component is liquid and comprises glycerol and/or lactic acid.

32. A method of mass spectrometry which employs a method of providing an ionic, gas phase, analyte species according to claim 28.

33. A method of infrared (IR) liquid matrix assisted laser desorption/ionisation (MALDI) time of flight (TOF) mass spectrometry (MS) which employs a method of providing an ionic, gas phase, analyte species according to claim 28.

34. A method of increasing the ratio, $A^1/M^1$, of analyte ion signal, $A^1$, to matrix ion signal, $M^1$, in infrared (IR) liquid matrix assisted laser desorption/ionisation MALDI mass spectrometry (MS), which method employs a modified ion source target according to claim 1, and wherein the increased ratio, $A^1/M^1$, is greater than the ratio obtain using an unmodified target plate, $A^0/M^0$, by a factor of at least 2.

* * * * *